US009549247B2

(12) United States Patent
Terada et al.

(10) Patent No.: US 9,549,247 B2
(45) Date of Patent: Jan. 17, 2017

(54) AUDIO MIXING SYSTEM

(75) Inventors: Kotaro Terada, Hamamatsu (JP); Hiroaki Fujita, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 134 days.

(21) Appl. No.: 13/598,071

(22) Filed: Aug. 29, 2012

(65) Prior Publication Data

US 2013/0230194 A1 Sep. 5, 2013

(30) Foreign Application Priority Data

Aug. 29, 2011 (JP) ..... 2011-185654

(51) Int. Cl.
*H04R 3/00* (2006.01)
*H04H 60/04* (2008.01)

(52) U.S. Cl.
CPC ..... *H04R 3/00* (2013.01); *H04H 60/04* (2013.01)

(58) Field of Classification Search
CPC ..... H04R 3/00; H04H 60/04
USPC ..... 381/119
See application file for complete search history.

(56) References Cited

U.S. PATENT DOCUMENTS 4,635,288 A 1/1987 Stadius
5,444,676 A * 8/1995 Balsamo et al. ..... 369/4
2004/0028247 A1* 2/2004 Aiso ..... G11B 27/002 381/119
2005/0190933 A1* 9/2005 Hamada et al. ..... 381/119
2006/0015198 A1* 1/2006 Okabayashi ..... G10H 1/0091 700/94
2006/0072771 A1 4/2006 Kloiber et al.
2007/0025568 A1* 2/2007 Aiso et al. ..... 381/119
2007/0058823 A1* 3/2007 Terada ..... 381/119
2007/0067055 A1* 3/2007 Terada ..... 700/94
2008/0069382 A1* 3/2008 Terada et al. ..... 381/119
2008/0175413 A1* 7/2008 Okabayashi ..... 381/119
2008/0215791 A1* 9/2008 Aoki et al. ..... 710/316
2009/0099672 A1* 4/2009 Terada ..... H04H 60/04 700/94
2009/0234477 A1 9/2009 Sekido et al.
2010/0246830 A1 9/2010 Terada

FOREIGN PATENT DOCUMENTS

CN 101848125 A 9/2010

OTHER PUBLICATIONS

Yamaha, PM5D Digital Mixing Console PM5D/PM5D-RH Owner's Manual, Apr. 2004, pp. 66-90 and 220-289.*

(Continued)

*Primary Examiner* — Fan Tsang
*Assistant Examiner* — Angelica M McKinney
(74) *Attorney, Agent, or Firm* — Morrison & Foerster LLP

(57) ABSTRACT

An audio mixing system comprises a plurality of input ports and output ports, and a plurality of input channels and output channels for controlling characteristic of input sound signals. Two or more input ports included in the plurality of input ports or two or more output ports included in the plurality of output ports are registered as a plurality of patch ports. By an instruction to collectively patch a port group, the input ports or the output ports registered as the plurality of patch ports are patched to input channels or output channels respectively by an input or an output patch.

9 Claims, 14 Drawing Sheets

(56) References Cited

OTHER PUBLICATIONS

Yamaha, PM5D Digital Mixing Console PM5D/PM5D-RH Owner's Manual , Apr. 2004, pp. 66-90 and 220-289.*
Ballagas, R. et al. (Mar. 14, 2004). "Patch Panel: Enabling Control-Flow Interoperability in Ubicomp Environments," *Proceedings of the Second IEEE Annual Conference on Pervasive Computing and Communications* (*PERCOM'04*), Piscataway, NJ, Mar. 14-17, 2004, IEEE, pp. 241-252.
European Search Report mailed Feb. 6, 2013, for EP Application No. 12181961.9, five pages.

* cited by examiner

AUDIO MIXING SYSTEM

BACKGROUND OF THE INVENTION

Field of the Invention

The present invention relates to an audio mixing system which enables collective patching of a port group having a plurality of ports to channels.

Description of the Related Art

Conventionally, there are known audio mixing systems which collect sounds played by musical instruments and vocal sounds collected by microphones, mix the sounds, and send the mixed sounds to a power amplifier and various kinds of recording apparatuses or send the mixed sounds to an effector and players who are playing the musical performance. Such a conventional audio mixing system has I/O units provided with input ports to which sound signals collected by microphones and sound signals supplied from digital recording apparatuses are input, and output ports which output digital sound signals, a sound signal processing unit for mixing digital sound signals and adding effects, and a console on which an operator operates various kinds of panel operating elements to realize a state where the musical performance is expressed most appropriately.

In this case, a multiplicity of input ports which are physical input terminals of an I/O unit are patched to logical input channels of the sound signal processing unit, respectively. On the input channels, the level and frequency response of input sound signals are controlled. The input channels are selectively connected to mixing buses. On the respective mixing buses, sound signals input from the input channels are mixed, so that the mixed signals are output from output channels corresponding to the mixing buses, respectively. Each output channel is patched to any one of output ports of the I/O unit by an output patch. The output ports are physical output terminals of the I/O unit. Each output port can be connected to any of the output channels as a source from which signals are to be output to the output port.

FIG. 21 indicates an example patch setting screen 100 for patching ports to channels in a conventional audio mixing system (Instruction Manual for DIGITAL PRODUCTION CONSOLE DM2000 Version 2, 77-79, [online] Yamaha Corporation, Internet <http://www2.yamaha.co.jp/manual/pdf/pa/japan/mixers/DM2000V2J1.pdf>, searched on Jun. 10, 2011).

The patch setting screen 100 indicated in FIG. 21 is a screen for patching input ports to input channels, respectively. On the upper row, channel numbers 100*b* of channels "1" to "8" are displayed, while channels numbers 100*b* of channels "9" to "16" are displayed on the lower row. Below the respective channel numbers 100*b*, names of corresponding ports 100*a* patched to the respective channels are displayed. On the patch setting screen 100, for instance, if a user selects channel 8, a frame of the port 100*a* situated below the channel 8 is displayed in a heavy line to indicate that this channel has been selected. By user's operation to display a port list 101 which is a list of input ports and user's selection of an input port "AD8", the input port "AD8" is patched to channel 8. Similarly, user's desired input ports are patched to input channels, respectively. Information about the settings of input patch can be stored in an input patch library.

FIG. 22 indicates another example of a patch setting screen 200 for patching input ports to input channels, respectively, in a conventional audio mixing system, (Instruction Manual for PM5D/PM5D-RH V2 DSP5D, 74-76, [online], Yamaha Corporation, Internet, http://www2.yamaha.co.jp/manual/pdf/pa/japan/mixers/pm5dv2_ja_om_g0.pdf> searched on Jun. 10, 2011).

On the patch setting screen 200 shown in FIG. 22, a matrix patch field 201 at which input ports of AD IN are patched to input channels is displayed. In the matrix patch field 201, port numbers 201*a* of input ports are displayed in a row as 1, 2, 3, . . . , while channel numbers 201*b* of input channels are displayed in a column as Channel 1, Channel 2, Channel 3, . . . . An input port patched to an input channel is indicated by a patch mark 201*c* displayed on a cell at which a corresponding row and a corresponding column intersect. In the shown example, the input port of port number "1" of AD IN is patched to the input channel "Channel 1". In a case where a user desires to change the input patching, the user causes the matrix patch field 201 to display input ports which are to be patched to input channels, and further causes the matrix patch field 201 to display input channels to which the ports are to be patched. By user's click on a cell at which a user's desired input port and a user's desired input channel intersect, the input port is patched to the input channel, so that the patch mark 201*c* is displayed at the cell.

FIG. 23 indicates the other example of a patch setting screen 300 for patching input ports to input channels, respectively, in a conventional audio mixing system (Instruction Manual for DIGITAL MIXING CONSOLE Version 3, 105-109, [online], Yamaha Corporation Internet, http://www2.yamaha.co.jp/manual/pdf/pa/japan/mixers/m7clv3_ja_om_h0.pdf> searched on Jun. 10, 2011).

On the patch setting screen 300 shown in FIG. 23, a patch button 300*a* and a selected channel field 300*b* are displayed. By a click on the patch button 300*a*, a port switch tab 300*c* and a list of ports 300*d* of a switched tab are displayed. On the selected channel field 300*b*, the name of a selected input channel is displayed. In the shown case, a channel name "Channel 1 (Vocal)" has been selected to be indicated on the selected channel field 300*b*. In the shown case, in addition, a tab "AD 1-16" of the port switch tab 300*c* has been selected, so that a list of 16 input ports "AD 1" to "AD 16" is displayed as the ports 300*d*. On the field of the ports 300*d*, as indicated in the figure, "AD 1" whose display color has been changed has been selected, so that the input port "AD 1" is to be patched to the input channel having the channel name "channel 1 (Vocal)". In a case where a user desires to patch a different input port to the input channel whose channel name is "channel 1 (Vocal)", the user is to click on the port switch tab 300*c* which includes the desired input port, and then selects the desired port.

Although the above-described three types of patching have been explained about the cases where input ports are patched to input channels, the patching by which output ports are patched to output channels can be performed similarly. Furthermore, although each port can be patched to a plurality of channels, each channel can only be assigned one port.

SUMMARY OF THE INVENTION

The conventional audio mixing systems have a problem that each channel has to be patched to a port in spite of a large number of input channels such as 32 channels, 98 channels or even a larger number of input channels, resulting in an enormous amount of time being required for patching. In addition, although the conventional audio mixing systems are known for concurrent connection between 8 input channels and 8 recording tracks, the conventional audio mixing systems have no flexibility, for the respective connections are fixed.

Therefore, an object of the present invention is to provide an audio mixing system which allows collective patching of a port group formed of a plurality of ports to channels.

In order to achieve the above-described object, it is a feature of the present invention to provide an audio mixing system including a plurality of input ports (30) adapted to receive input sound signals; a plurality of input channels (32) adapted to receive input sound signals from the plurality of input ports; an input patch portion (31) adapted for selectively patching the plurality of input ports to the plurality of input channels; a mix bus (33) adapted for mixing sound signals supplied from the plurality of input channels; a plurality of output channels (35) adapted for inputting sound signal mixed by the mix bus; a plurality of output ports (38) adapted to output sound signals; an output patch portion (37) adapted for selectively patching the plurality of output ports to the plurality of output channels; and a port registration portion (60, 62) adapted for registering two or more input ports included in the plurality of input ports or two or more output ports included in the plurality of output ports as a plurality of patch ports, wherein the input patch portion or the output patch portion is provided with a group patch portion (61, S10, S11, S13) adapted for patching the plurality of patch ports registered by the port registration portion to two or more channels included in the plurality of input channels or two or more channels included in the plurality of output channels, respectively. The plurality of input channels and a plurality of output channels control characteristic of the input sound signal for example.

In this case, the port registration portion may be capable of registering a plurality of port groups each formed of the plurality of patch ports; and the group patch portion may have a port group selection portion (61*d*, S11) adapted for selecting one port group from among the registered port groups, and may patch the patch ports belonging to the selected port group to the two or more channels included in the plurality of input channels or to the two or more channels included in the plurality of output channels, respectively.

Furthermore, the group patch portion may a have top channel designation portion (61*b*, S10) adapted for designating a top channel of the plurality of channels to which the plurality of patch ports are to be patched, and may sequentially patch the plurality of patch ports to the two or more channels included in the plurality of input channels or to the two or more channels included in the plurality of output channels, starting at the designated top channel.

Furthermore, the group patch portion may further have a fixed channel designation portion (65*d*) adapted for designating an input channel which is fixed without changing a state of patching of input port to the input channel or an output channel which is fixed without changing a state of patching of output port to the output channel; and the input channel or the output channel designated by the fixed channel designation portion may be excluded from the target channels to which the patch ports are to be patched.

Furthermore, the group patch portion may further have a re-patch portion (61*g*, S13) adapted for re-patching, before sequentially patching the plurality of patch ports to the two or more channels from the top channel, input ports or output ports which have been already patched to the top and later input or output channels to input channels or output channels displaced by as many channels as the patch ports in a direction in which the patch ports will be sequentially patched.

Furthermore, the group patch portion may further have a fixed channel designation portion (65*d*) adapted for designating an input channel which is fixed without changing a state of patching of input port to the input channel or an output channel which is fixed without changing a state of patching of output port to the output channel; and the input channel or the output channel designated by the fixed channel designation portion may be excluded from the target channels to which the patch ports are to be patched, and may be excluded from the target channels to which the input ports or the output ports are to be re-patched by the re-patch portion.

Furthermore, the group patch portion may further have an unavailable port designation portion (67*d*) adapted for designating an input port which cannot be patched to any input channel or an output port which cannot be patched to any output channel; and the input port or the output port designated by the unavailable port designation portion may be excluded from the target ports which are to be patched to the plurality of input channels or the plurality of output channels by the group patch portion.

Furthermore, the group patch portion may further cancel an already made patch of the input port or the output port designated by the unavailable port designation portion to an input channel or an output channel.

The present invention configured as described above enables collective patching of a port group formed of a plurality of ports to channels to facilitate re-patching without requiring a user to re-patch a port to a channel one by one unlike the conventional audio mixing systems. In a case where an apparatus such as I/O unit is newly added to the audio mixing system, particularly, the user can perform re-patching only by a simple task which requires a short time, that is, only by creating a port group for the newly added apparatus and reconfiguring the audio mixing system.

In carrying out the invention, the invention is not limited to the invention of the audio mixing system, but can be carried out as inventions of a patching method and a computer program for patching applied to an audio mixing system.

DESCRIPTION OF THE PREFERRED EMBODIMENT

Figure 1:
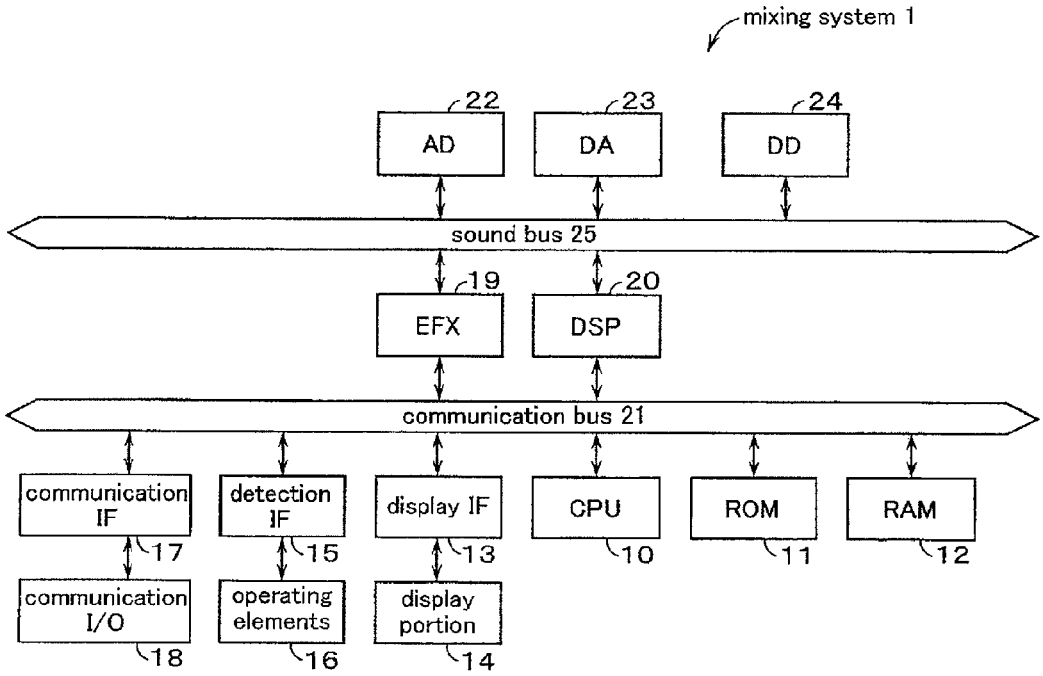
FIG. 1 is a block diagram indicative of a hardware configuration of an audio mixing system according to an embodiment of the present invention.

FIG. 1 is a block diagram indicative of a hardware configuration of an audio mixing system 1 which is an embodiment of the present invention.

In the audio mixing system 1, a CPU (central processing unit) 10 executes a management program (OS: operating system) to control the entire operation of the audio mixing system 1 on the OS. The audio mixing system 1 has a non-volatile ROM (read-only memory) 11 which stores operating software such as a control program executed by the CPU 10, and a RAM (random-access memory) 12 which serves as a working area for the CPU 10 to store various kinds of data. By executing the control program, the CPU 10 processes input sound signals by a DSP (digital signal processor) 20 to mix the signals. By employing a rewritable ROM such as a flash memory as the ROM 11, the operating software can be rewritten to facilitate update of the operating software. Under the control of the CPU 10, the DSP 20 controls tone volume level and frequency response of input sound signals on the basis of set parameters, and mixes the sound signals to perform sound signal processing which controls sound characteristics such as tone volume, pan and effects in accordance with the parameters. An effector (EFX) 19 adds effects such as reverb, echo and chorus to the mixed audio signals under the control of the CPU 10.

A display IF 13 is a display interface for displaying, on a display portion 14 such as a liquid crystal display, various kinds of screens relating to sound signal processing such as a patch setting screen. A detection IF 15 scans operating elements 16 such as faders, knobs and switches provided on a panel of a console of the audio mixing system 1 and detects user's operation of the operating elements 16 in order to edit and manipulate parameters for use in sound signal processing in accordance with the detected signals indicative of the user's operation of the operating elements 16. A communication IF 17 is a communication interface for communicating with an external apparatus through a communication I/O 18, and is an interface for network such as Ethernet (trademark). The CPU 10, the ROM 11, the RAM 12, the display IF 13, the detection IF 15, the communication IF 17, the EFX 19 and the DSP 20 transmit/receive data and the like with each other through a communication bus 21.

The EFX 19 and the DSP 20 transmit/receive data and the like to/from an AD 22, a DA 23 and a DD 24 which form an input/output portion through a sound bus 25. The AD 22 has one or more physical input ports which are input terminals to which analog sound signals are input. The analog sound signals input to the input ports of the AD 22 are converted to digital sound signals to be transmitted to the sound bus 25. The DA 23 has one or more physical output ports which are output terminals which externally output mixed signals. The digital sound signals received by the DA 23 through the sound bus 25 are converted to analog sound signals to be output from the output ports, so that the signals are output from speakers placed in a venue and a stage, and connected to the output ports.

The DD 24 has one or more physical input ports which are input terminals to which digital sound signals are input, and one or more physical output ports which are output terminals which externally output mixed digital sound signals. The digital sound signals input to the input ports of the DD 24 are transmitted to the sound bus 25, while the digital sound signals received through the sound bus 25 are output from the output ports to be supplied to a digital recorder or the like connected to the output ports. The digital sound signals transmitted from the AD 22 and the DD 24 to the sound bus 25 are received by the DSP 20, so that the DSP 20 performs the above-described digital signal processing. The mixed digital sound signals transmitted from the DSP 20 to the sound bus 25 are received by the DA 23 or the DD 24.

Figure 2:
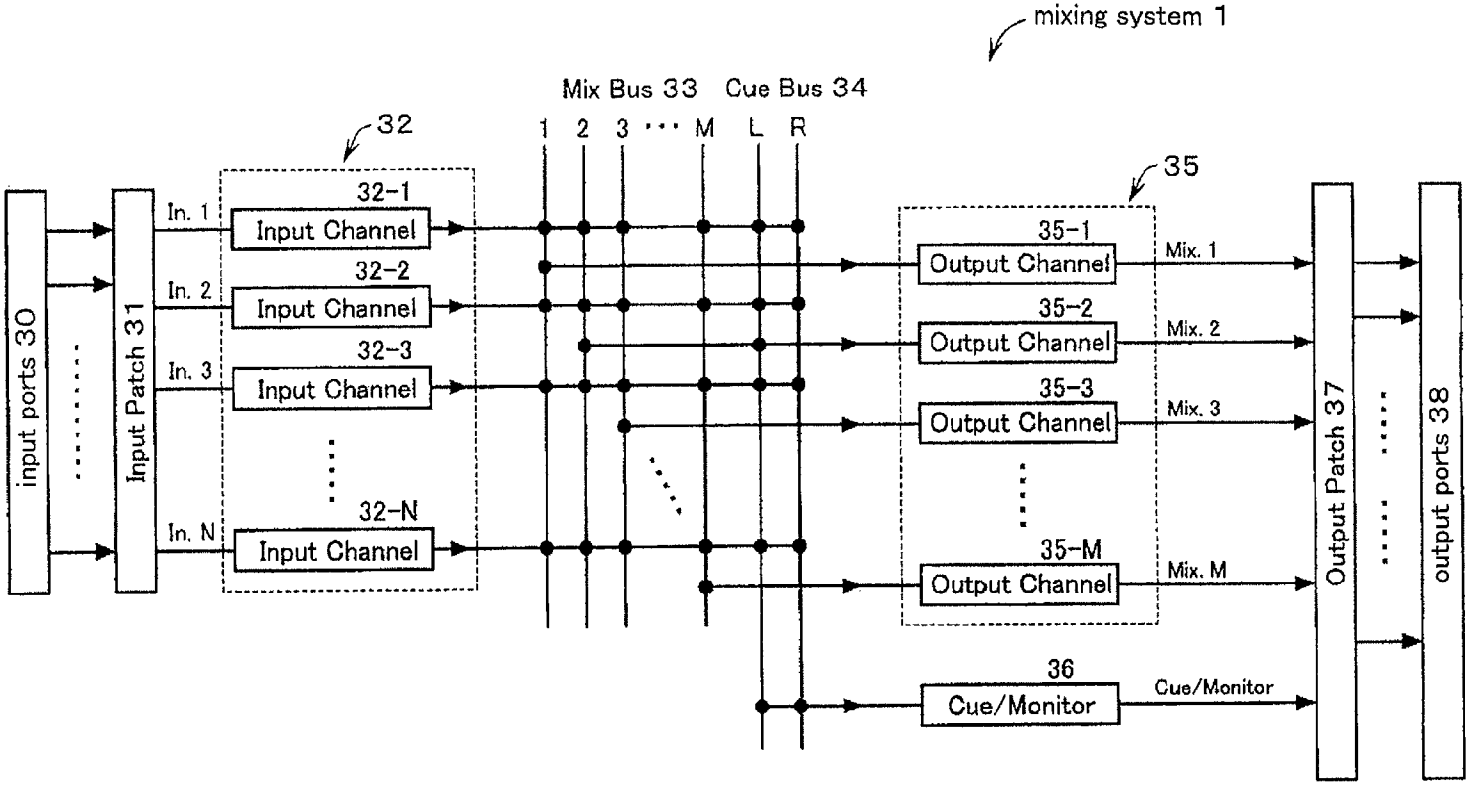
FIG. 2 is a functional block diagram equivalently indicative of a processing algorithm of the audio mixing system according to the present invention.

Next, FIG. 2 is a functional block diagram equivalently indicative of a processing algorithm of the audio mixing system 1 according to the embodiment of the present invention.

In FIG. 2, digital sound signals received through a plurality of input ports 30 are input to an input patch 31. The input ports 30 are the physical input terminals of the AD 22 and the DD 24. At the input patch 31, respective physical input ports which receive input sound signals are selectively patched (connected) to logical input channels 32-1, 32-2, 32-3, . . . 32-N of an input channel portion 32 having N number of channels (N: an integer which is 1 or greater, such as 96 channels). In this case, although each input port can be patched to a plurality of input channels, each input channel can only be assigned one input port.

To the input channels 32-1 to 32-N, sound signals In. 1, In. 2, In. 3, . . . In. N input from the input ports 30 patched at the input patch 31 are supplied, respectively. In the respective input channels 32-1 to 32-N, sound characteristics of the sound signals In. 1, In. 2, In. 3, . . . In. N input to the input channels are controlled. More specifically, characteristics of sound signals input to the input channels 32-1 to 32-N of the input channel portion 32 are controlled by an equalizer and a compressor for each input channel, while the send level of the sound signals is also controlled, so that the controlled signals are transmitted to M number (M: an integer of 1 or greater) of mix buses 33 and L and R stereo cue buses 34. In this case, the respective signals output from N number of input channels of the input channel portion 32 are selectively output to one or more of the M number of mix buses 33.

In each of the M number of mix buses 33, signals selectively input from one or more input channels of the N number of input channels are mixed, resulting in M ways of mixed outputs. The mixed outputs from M number of mix buses 33 are output to output channels 35-1, 35-2, 35-3, . . . , 35-M of an output channel portion 35 having M number of channels, respectively. In the respective output channels 35-1 to 35-M, characteristics of sound signals such as frequency balance are controlled by an equalizer and a compressor, so that the controlled signals are output as output channel signals Mix. 1, Mix. 2, Mix. 3, . . . Mix. M. The signals Mix. 1 to Mix. M output from M number of output channels are output to an output patch 37. From the L and R cue buses 34, cue/monitoring signals obtained by mixing one or more input channel signals input from the N number of input channels are output to a cue/monitoring portion 36. The cue/monitoring output obtained by controlling the characteristics of sound signals such as frequency balance by an equalizer and a compressor in the cue/monitoring portion 36 is output to the output patch 37.

At the output patch 37, each of signals Mix. 1 to Mix. M output from M number of output channels of the output channel portion 35 and the cue/monitoring output from the cue/monitoring portion 36 can be selectively patched to any of output ports 38. To the respective output ports 38, signals output from the output channels patched by the output patch 37 are supplied. In the output ports 38, digital signals output from the output channels are converted to analog output signals so that the analog output signals will be amplified by an amplifier connected to the patched output ports 38 and emitted as tones from a plurality of speakers placed on a venue. In addition, the analog output signals output from the output ports 38 are also supplied to in-ear monitors worn by musicians on a stage, and reproduced by stage monitoring speakers placed near the musicians.

Digital sound signals output from the output port 38 patched by the output patch 37 can be also supplied to a recorder and a DAT connected to the output port 38 so that the digital sound signals can be digitally recorded. Furthermore, the cue/monitoring output can be converted to analog sound signals so that the analog sound signals will be output through the output port 38 patched by the output patch 37 from a monitoring speaker placed in an operator's room or a headphone worn by an operator to allow the operator to check the sound signals. As described above, the output patch 37 selectively patches logical output channels to the output ports which are the physical output terminals.

The input channels 32-1 to 32-N of the input channel portion 32 indicated in FIG. 2 are configured similarly. The configuration of the input channel will be indicated in FIG. 3(*a*), taking the input channel 32-*i* as an example.

Figure 3:
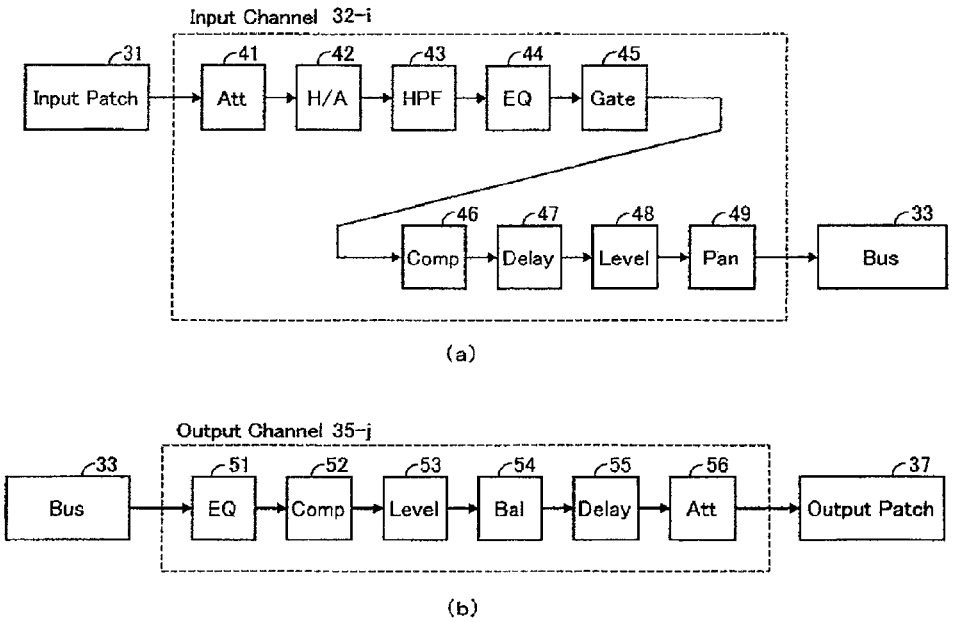
FIG. 3 is circuit block diagrams indicative of respective configurations of an input channel and an output channel of the audio mixing system of the present invention.

To the input channel 32-*i* indicated in FIG. 3(*a*), one of the input ports will be patched by the input patch 31. The input channel 32-*i* is formed by cascade-connecting an attenuator (ATT) 41, a head amplifier (H/A) 42, a high pass filter (HPF) 43, an equalizer (EQ) 44, a noise gate (GATE) 45, a compressor (Comp) 46, a delay (Delay) 47, a level controller (Level) 48 and a pan (Pan) 49. The attenuator (ATT) 41 controls attenuation of an input digital sound signal. The head amplifier (H/A) 42 amplifies input digital sound signals. The high pass filter (HPF) 43 cuts the band of input digital sound signals having frequencies lower than a specific frequency. The equalizer (EQ) 44 controls frequency response of input digital sound signals. The equalizer (EQ) 44 can vary respective frequency responses of four bands: HI, MID HI, LOW MID, and LOW, for example.

The noise gate (Gate) 45 is a gate which cuts off noise. When the level of an input digital sound signal is equal to or lower than a specified value, more specifically, the gain of the input digital audio signal is abruptly reduced to cut off noise. The compressor (Comp) 46 reduces dynamic range of an input digital sound signal to prevent the input digital sound signal from saturation. The delay (Delay) 47 delays an input digital sound signal for a period of time so that the distance between a tone generator and a microphone connected to the patched input port will be corrected. The level controller (Level) 48 is a means of varying level such as the level of a motor-driven fader for controlling the send level from the input channel 32-*i* to the mix bus 33. The pan (Pan) 49 controls lateral localization of a signal transmitted from the input channel 32-*i* to two stereo mix buses 33.

A digital sound signal output from the input channel 32-*i* can be supplied to a desired number of mix buses 33, while the signal is to be also supplied to the cue buses 34.

The output channels 35-1 to 35-M of the output channel portion 35 indicated in FIG. 2 are configured similarly. The configuration of the output channel will be indicated in FIG. 3(*b*), taking the output channel 35-*j* as an example.

To the output channel 35-*j* indicated in FIG. 3(*b*), the mixed output from the j-th mix bus 33 is input. The output channel 35-*j* is formed by cascade-connecting an equalizer (EQ) 51, a compressor (Comp) 52, a level controller (Level) 53, a balance (Bal) 54, a delay (Delay) 55 and an attenuator (ATT) 56. The equalizer (EQ) 51 controls frequency response of digital sound signals which are to be output. The equalizer (EQ) 51 can vary respective electric characteristics of six bands: HI, MID HI, MID, LOW MID, LOW and SUB MID, for example. The compressor (Comp) 52 reduces dynamic range of a digital sound signal which is to be output to prevent the digital sound signal which is to be output from saturation.

The level controller (Level) 53 is a means of varying level such as the level of a motor-driven fader for controlling the output level from the output channel 35-*j* to the output patch 37. The balance (Bal) 54 controls the tone volume balance between right and left in a case where the output channel 35-*j* is a stereo channel. The delay (Delay) 55 delays a digital sound signal which is to be output for a period of time in order to correct the distance between speakers and the localization. The attenuator (ATT) 56 controls attenuation of a digital sound signal which is to be output to the output patch 37.

Figure 4:
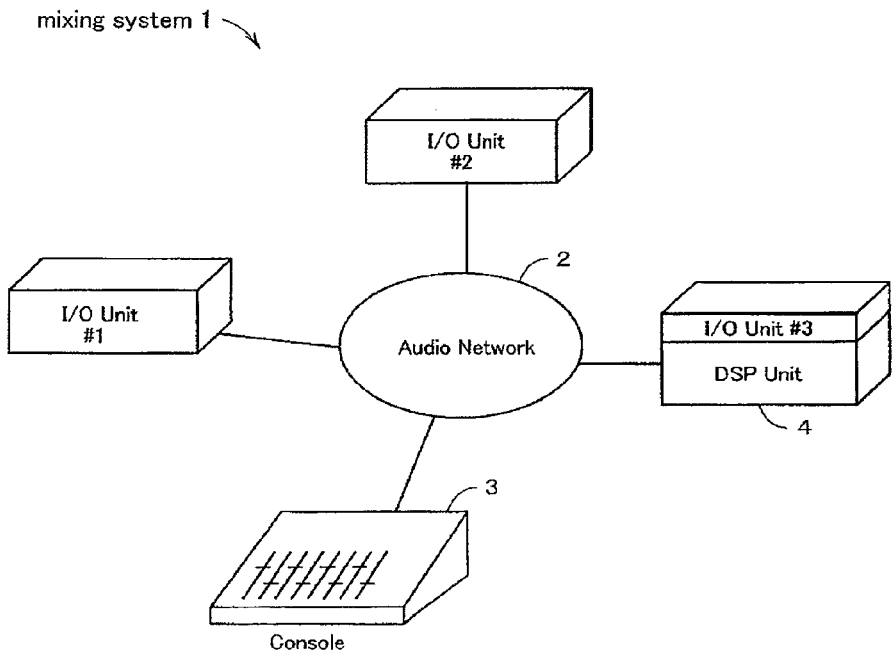
FIG. 4 is a diagram indicative of a connection image of units which form the audio mixing system of the present invention.

Next, a connection image of units which form the audio mixing system 1 of the present invention is indicated in FIG. 4.

As indicated in FIG. 4, the audio mixing system 1 of the present invention is configured by connecting three I/O units #1, #2 and #3 which form an input/output portion, a DSP unit 4 having the I/O unit #3, and a console 3 with an audio network 2. The console 3 is used by a user in order to control the audio mixing system 1 by user's operation of various kinds of operating elements provided on a panel of the console 3 to realize a state in which the musical performance is most appropriately expressed. Each of the three I/O units #1, #2 and #3 includes at least one of the AD 22, DA 23 and DD24 shown in FIG. 1. According to their respective configurations, more specifically, the I/O units #1, #2 and #3 have physical input ports which are input terminals to which a microphone is connected or physical output ports which are output terminals to which an amplifier and the like are connected. The DSP unit 4 is a unit for realizing the functions of the EFX 19 and the DSP 20 shown in FIG. 1. The console 3 is a unit for realizing respective functions of the components ranging from the CPU 10 to the operating elements 16 shown in FIG. 1. Each of the I/O units #1, #2 and #3, the DSP unit 4 and the console 3 has the communication IF 17 and the communication I/O 18 so that the respective units can be connected by the audio network 2 including the communication bus 21 and the sound bus 25 with each other.

In the audio mixing system 1 of the present invention shown in FIG. 4, sound signals input from the input ports of the I/O units #1 and #2 are supplied to the DSP unit 4 through the audio network 2. Sound signals input from the input ports of the I/O unit #3 are supplied directly to the DSP unit 4. The DSP unit 4 controls the level and frequency response of the supplied digital sound signals, mixes the controlled signals in a desired combination, and controls the level and frequency response of the mixed output. In this case, effects can be added to the sound signals. The mixed output which has been output from the DSP unit 4 is transmitted to the I/O units #1, #2 and #3 through the audio network 2, so that the mixed output is output from the output ports of the I/O units #1, #2, #3 to be supplied to the amplifier and the like.

By user's operation of the operating elements 16 provided on the console 3, sound characteristics of respective modules ranging from the Att 41 to the Pan 49 of the input channel 32-*i* shown in FIG. 3(*a*) and sound characteristics of respective modules ranging from the EQ 51 to the Att 56 of the output channel 35-*j* shown in FIG. 3(*b*) can be changed so that sound signals in the DSP unit 4 will have desired level and frequency response.

Figure 5:
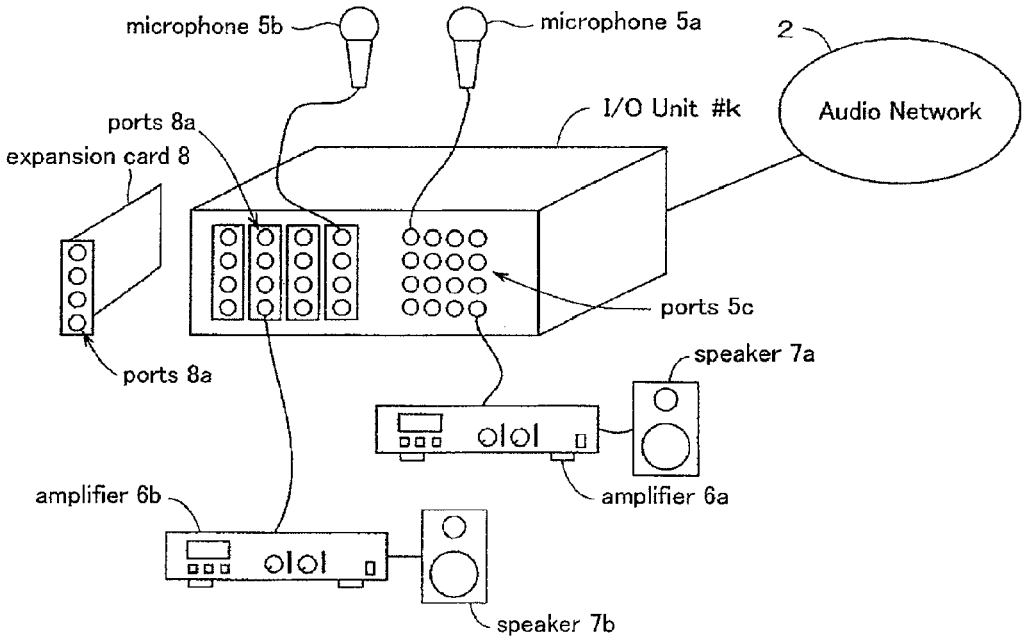
FIG. 5 is a connection image of an I/O unit and external apparatuses in the audio mixing system of the present invention.

FIG. 5 indicates a connection image of the I/O unit and external apparatuses in the audio mixing system 1 of the invention. The I/O unit #k shown in FIG. 5 is any one of the I/O units #1, #2 and #3.

The I/O unit #k shown in FIG. 5 has a plurality of physical ports 5*c*. As the physical ports 5*c*, there exist a plurality of input ports and a plurality of output ports. A microphone 5*a* is connected to an input port of the ports 5*c*. An amplifier 6*a* is connected to an output port of the ports 5*c*. To the amplifier 6*a*, a speaker 7*a* is connected so that sound signals amplified by the amplifier 6*a* will be emitted as tones from the speaker 7*a*.

The I/O unit #k has four expansion slots, for example, into each of which an expansion card 8 having ports can be inserted. In the case of FIG. 5, the expansion cards 8 are inserted into the respective slots of the I/O unit #k. Among the expansion cards 8, more specifically, the expansion card 8 for AD has ports 8*a* which are input ports. To the input port of the expansion card 8 for AD, a microphone 5*b* is connected.

Among the inserted expansion cards, furthermore, the expansion card 8 for DA has ports 8*a* which are output ports. To the output port of the expansion card 8 for DA, an amplifier 6*b* is connected. To the amplifier 6*b*, a speaker 7*b* is connected so that sound signals amplified by the amplifier 6*b* will be emitted as tones from the speaker 7*b*. The I/O unit #k is connected to the audio network 2, so that sound signals input to the input ports will be transmitted to the DSP unit 4 through the audio network 2. The mixed output which has been output from the DSP unit 4 is received by the I/O unit #k through the audio network 2, so that the I/O unit #k will output the mixed output from a specified output port.

It is the characteristic configuration of the audio mixing system 1 of the invention that port groups each having a plurality of ports can be created whereas physical ports belonging to a port group can be collectively patched to logical channels of the audio mixing system 1. There are two kinds of port groups: port groups each having only input ports and port groups each having only output ports. Any port group having both an input port and an output port cannot be created.

Figure 6:
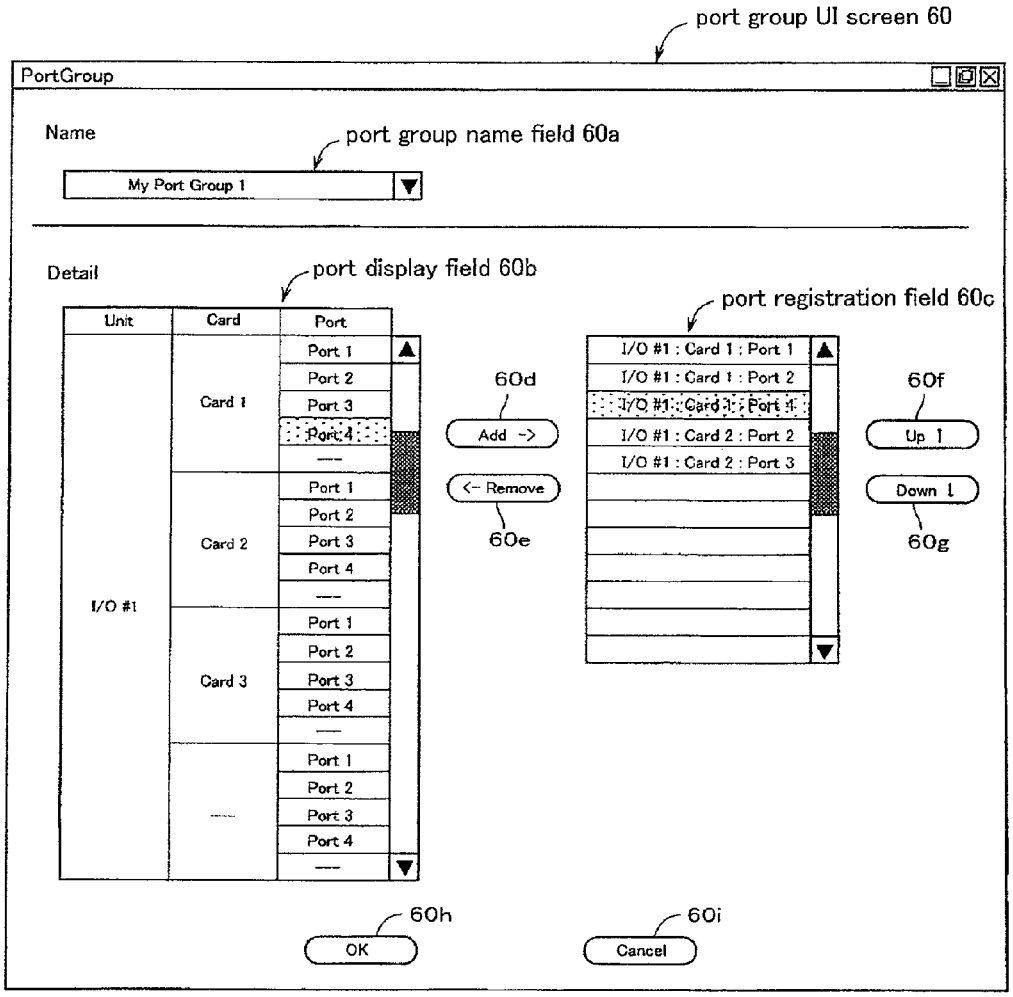
FIG. 6 is a diagram indicative of a port group UI screen displayed in the audio mixing system of the present invention.

FIG. 6 indicates a port group UI screen 60 which is displayed on the display portion 14 when a port group is to be created/edited. The port group UI screen 60 is formed of a Name area situated at the top of the screen and a Detail area situated below the Name area. On the Name area, a port group name field 60*a* is provided. By a click on "▼" situated on the right end of this field, a list of port groups is displayed. When a desired one of the port groups included in the list is selected, the name of the selected port group is displayed on the port group name field 60*a*. In the shown example, a port group whose name is "My Port Group 1" has been selected, so that this port group can be edited. Furthermore, a new port group can be created by giving a new name to an edited port group and registering the port group with the new name.

On the Detail area of the port group UI screen 60, a port display field 60*b* for indicating the details of the ports provided for the audio mixing system 1 and a port registration field 60*c* for indicating ports registered in the port group shown in the port group name field 60*a* are displayed.

The port registration field 60*c* is a table in which ports which will be sequentially assigned to channels are specified. These ports are the physical input ports or output ports of the I/O units or the expansion cards.

The port display field 60*b* is configured by a Unit field for indicating the I/O unit numbers which have the ports, a Card field for indicating identification numbers (ID) of the expansion cards inserted into the I/O units, and a Port field for indicating the identification numbers (ID) of the ports of the I/O units or the expansion cards. On a right portion of the port display field 60*b*, in addition, a scroll bar and buttons are provided. By scrolling the port display field 60*b* up or down, the user can check all the ports of the I/O units and the expansion cards provided for the audio mixing system 1. In the shown example, the I/O unit #1 (I/O #1) is displayed on the Unit field, while three expansion cards "Card 1", "Card 2" and "Card 3" inserted into the expansion slots of the I/O unit #1 are displayed on the Card field. On the Port field, ports "Port 1", "Port 2", "Port 3", "Port 4", . . . , of "Card 1", ports "Port 1", "Port 2", "Port 3", "Port 4", . . . , of "Card 2", ports "Port 1", "Port 2", "Port 3", "Port 4", . . . , of "Card 3", and ports "Port 1", "Port 2", "Port 3", "Port 4", . . . , of the I/O unit #1 are displayed.

Because there exist input ports and output ports as ports, the display color or the display characters may vary according to the port type so that the user can discern between the input ports and the output ports at a glance. Alternatively, in a case where "Port 1" is an input port, the port may be displayed as "Input Port 1". In a case where "Port 1" is an output port, the port may be displayed as "Output Port 1". The other ports can be displayed similarly.

On the port registration field 60*c* which is a table in which ports which are to be sequentially assigned to channels are specified, ports which will be registered in the port group indicated in the port group name field 60*a* are displayed. In the shown example, in the port group "My Port Group 1", five ports "I/O #1: Card 1: Port 1", "I/O #1: Card 1: Port 2", "I/O #1: Card 1: Port 4", "I/O #1: Card 2: Port 2" and "I/O #1: Card 2: Port 3" are registered. On a right portion of the port registration field 60*c*, in addition, a scroll bar and buttons are provided. By scrolling the port registration field 60*c* up or down, the user can check all the registered ports. By pressing an "Up" button 60*f* provided on the right of the port registration field 60*c*, furthermore, the port registration field 60*c* is scrolled up. By pressing a "Down" button 60*g* provided below the "Up" button 60*f*, the port registration field 60*c* is scrolled down. By use of these buttons as well, the user can scroll the port registration field 60*c* up or down to check the registered ports.

Between the port display field 60*b* and the port registration field 60*c*, an Add button 60*d* and a Remove button 60*e* are provided. By selecting a desired port from among the ports included in the Port field of the port display field 60*b* and clicking the Add button 60*d*, the selected port is displayed and registered in the port registration field 60*c*. In the shown example, "Port 4" of "Card 1" of "I/O #1" has been selected in the port display field 60*b* to change the display color of "Port 4". In the shown example, furthermore, the Add button 60*d* has been clicked, so that "I/O #1: Card 1: Port 4" has been added to the port registration field 60*c* with the display color of "I/O #1: Card 1: Port 4" being changed.

By selecting any one of the ports listed in the port registration field 60*c* and clicking the Remove button 60*e*, the selected port is deleted from the port registration field 60*c* to cancel the registration of the port. By clicking an OK button 60*h* provided on the left side of the lower part of the port group UI screen 60 after the completion of the editing, port group information of the port group "My Port Group 1" is overwritten with the edited port group information. By clicking a Cancel button 60*i* provided on the right of the OK button 60*h*, the edited data is abandoned to close the port group UI screen 60.

In a case where the Add button 60*d* is clicked in order to add an output port (input port) to a port group comprised of input ports (output ports), a message saying that the port cannot be added due to different port type is displayed in order to prevent wrong registration.

The port group information of the created port group is stored in a memory area provided in the RAM 12. When the power of the audio mixing system 1 is turned off, the port group information is stored in a large-capacity storage device such as a hard disk which is provided for the audio mixing system 1 and is not shown. When the audio mixing system 1 is started again, the port group information is to be read from the large-capacity storage device to be stored in the memory area of the RAM 12.

Figure 7:
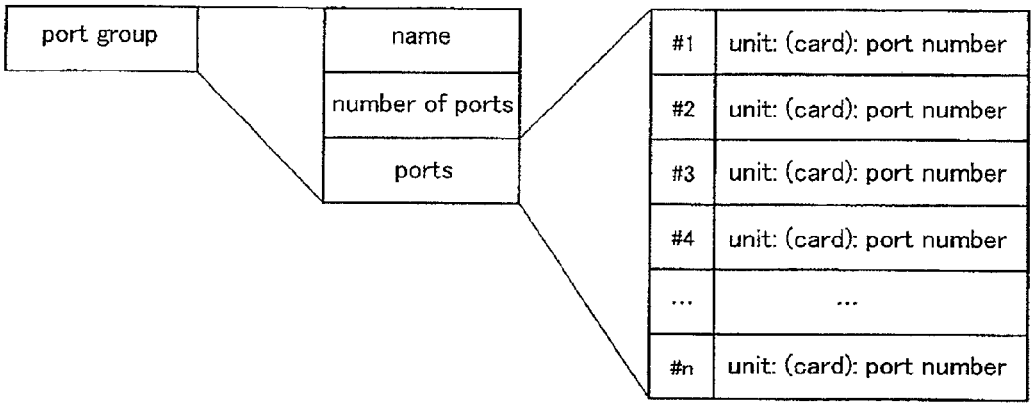
FIG. 7 is a diagram indicative of a memory image of port group information used in the audio mixing system of the present invention.

FIG. 7 indicates a data structure which is a memory image of the port group information. As indicated in FIG. 7, the port group information is formed of information about "name", information about "number of ports" and information about "ports" of the port group. As the information about "ports", information about all the ports registered in the port group is recorded in sequence. In a case where n number of ports have been registered in the port group, identification numbers #1 to #n are sequentially assigned to the ports so that the ports will be assigned to channels in the order of #1 to #n. As indicated in the figure, for example, the information of the port identification number #1 includes identification information of I/O unit, identification information of an expansion card in a case of an expansion card, and a port number. The information of the port identification numbers #2 to #n is configured similarly.

The information about "ports" also includes information indicative of whether the ports of port identification numbers are input ports or output ports.

Figure 8:
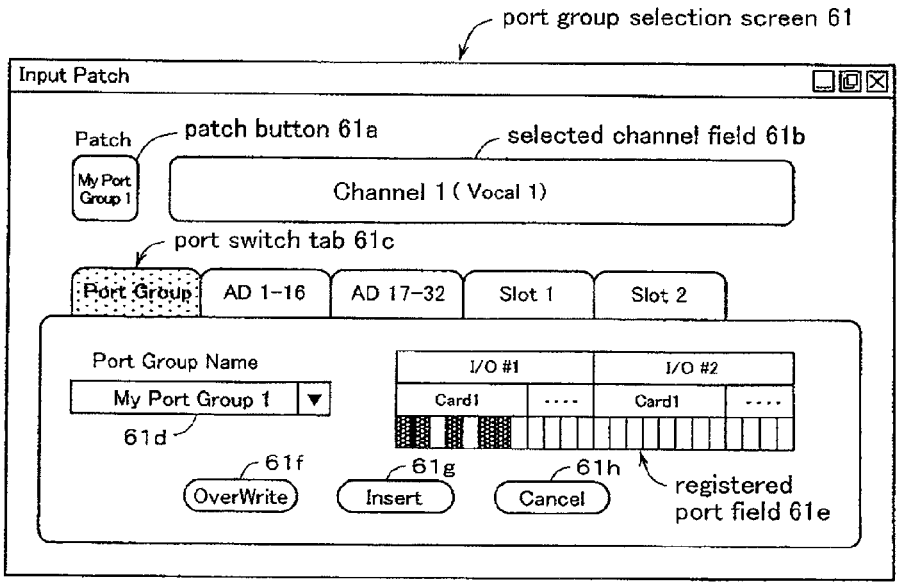
FIG. 8 is a port group selection/patch screen displayed when a port group is patched in the audio mixing system of the present invention.

FIG. 8 indicates a port group selection/patch screen 61 of "Input Patch" displayed on the display portion 14 when input ports are patched to input channels at the input patch 31 of the audio mixing system 1 of the present invention. Although each input port can be patched to a plurality of input channels, each input channel can only be assigned one input port.

On the top of the port group selection/patch screen 61 shown in FIG. 8, a rectangular patch button (Patch) 61*a* and a selected channel field 61*b* which is rectangular and long in a lateral direction are arranged side by side. By a click on the patch button 61*a*, a port switch tab 61*c* and tab information about the switched tab are displayed on an area ranging from the middle to the lower part of the screen 61. In a case where the user desires to collectively patch input ports included in a port group to input channels, the tab is switched to "Port Group" as indicated in the figure. Then, a port group can be selected at a port group name field (Port Group Name) 61*d*, so that port information about ports registered in the selected port group is displayed on a registered port field 61*e*.

On the port group name field (Port Group Name) 61*d*, by a click on a button "▼" situated on the right end of the field, a list of port groups is displayed to allow the user to select a desired port group. In this case, it is preferable that a list of port groups each of which is formed of input ports is displayed for the screen of "Input Patch" whereas a list of port groups each of which is formed of output ports is displayed for the screen of "Output Patch".

On the lower part of the area in which the tab information is displayed, an OverWrite button 61*f*, an Insert button 61*g* and a Cancel button 61*h* are provided. In the shown case, a port group whose port group name is "My Port Group 1" has been selected. As shown in the registered port field 61*e*, as for this port group, the display color of positions corresponding to respective port numbers of Port 1, Port 2, Port 4, Port 6 and Port 7 of Card 1 of I/O #1 has been changed to indicate the registration of these five ports.

On the selected channel field 61*b*, the top channel of the patching of input ports registered in the port group to input channels is selected to display the name of the selected top channel. In the shown case, an input channel whose channel name is "Channel 1 (Vocal 1)" has been selected as the top channel.

Figure 23:
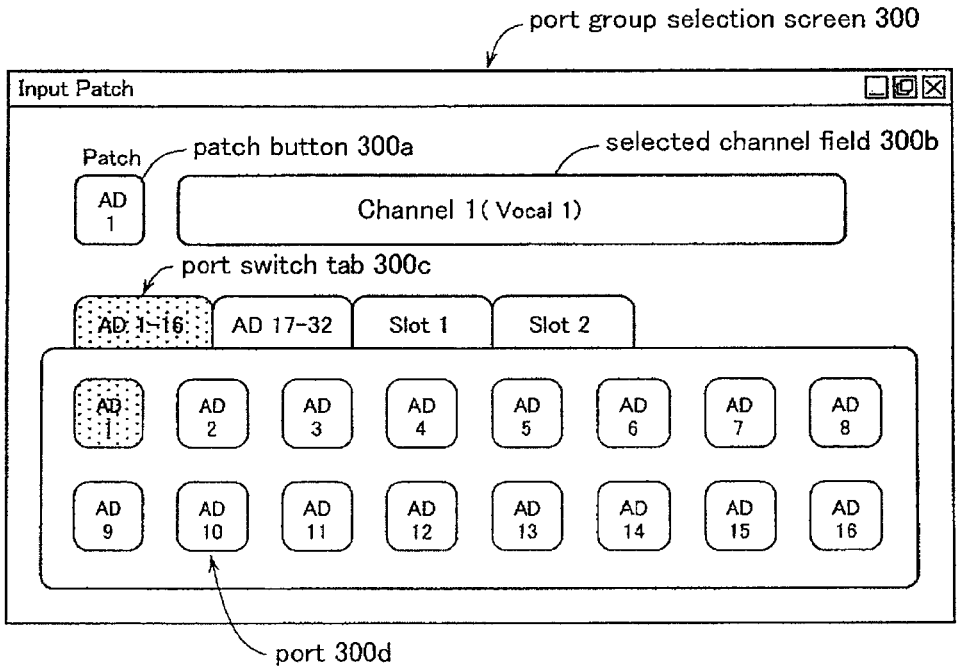
FIG. 23 is the other example patch setting screen which is displayed on a conventional audio mixing system and at which ports are patched to channels.

When the tab is switched to "AD 1-16", respective port names of 16 input ports AD 1 to AD 16 are displayed on the area for displaying tab information as shown in FIG. 23, whereas an input port selected from among the displayed 16 input ports is to be patched to the input channel indicated in the selected channel field 61*b*. In other words, each input port is to be patched to an input channel one by one.

As indicated in FIG. 8, by a click on the OverWrite button 61*f* with the input channel whose channel name is "Channel 1 (Vocal 1)" being selected as the top channel and the port group whose name is "My Port Group 1" being selected, an OverWrite process is performed. By the OverWrite process, the port which has been patched to the input channel "Channel 1 (Vocal 1)" which is the top channel to be patched is replaced with Port 1 of Card 1 of I/O #1 so that Port 1 of Card 1 of I/O #1 will be patched to the input channel Ch 1 (Vocal 1). The port which has been patched to the second input channel "Channel 2" is replaced with Port 2 of Card 1 of I/O #1 so that Port 2 of Card 1 of I/O #1 will be patched to the second input channel "Channel 2". The port which has been patched to the third input channel "Channel 3" is replaced with Port 4 of Card 1 of I/O #1 so that Port 4 of Card 1 of I/O #1 will be patched to the third input channel "Channel 3". The port which has been patched to the fourth input channel "Channel 4" is replaced with Port 6 of Card 1 of I/O #1 so that Port 4 of Card 1 of I/O #1 will be patched to the fourth input channel "Channel 4". The port which has been patched to the fifth input channel "Channel 5" is replaced with Port 7 of Card 1 of I/O #1 so that Port 7 of Card 1 of I/O #1 will be patched to the fifth input channel "Channel 5". As described above, ports of the port group are patched to the same number of input channels as the number of ports of the port group, starting at the top channel, so that ports which have been patched to the input channels are overwritten with the ports of the port group. After the patching, input patch information indicative of the relation between the respective input ports and the patched input channels of the input patch 31 is stored in the memory area of the RAM 12.

By a click not on the OverWrite button 61*f* but on the Insert button 61*g*, an Insert process is performed. By the Insert process, the same number of ports as the ports belonging to the port group are re-patched to input channels whose respective channel numbers increase by 5 which is the same number as the number of the ports of the port group so that the top channels "Channel 1" to "Channel 5" will become vacant. More specifically, ports patched to the top channels, "Channel 1" to "Channel 5" are re-patched to channels "Channel 6" to "Channel 10", respectively. Then, the vacant channels "Channel 1" to "Channel 5" are assigned ports as follows: Port 1 of Card 1 of I/O #1 is patched to the top channel "Channel 1". Port 2 of Card 1 of I/O #1 is patched to the second channel "Channel 2". Port 4 of Card 1 of I/O #1 is patched to the third channel "Channel 3". Port 6 of Card 1 of I/O #1 is patched to the fourth channel "Channel 4". Port 7 of Card 1 of I/O #1 is patched to the fifth channel "Channel 5". As described above, the same number of input channels as the ports of the port group are emptied, starting counting at the top channel. Then, the ports of the port group are patched to the emptied input channels so that the ports of the port group will be inserted. After the patching, input patch information indicative of the relation between the input ports and the input channels of the input patch 31 is stored in the memory area of the RAM 12.

Figure 9:
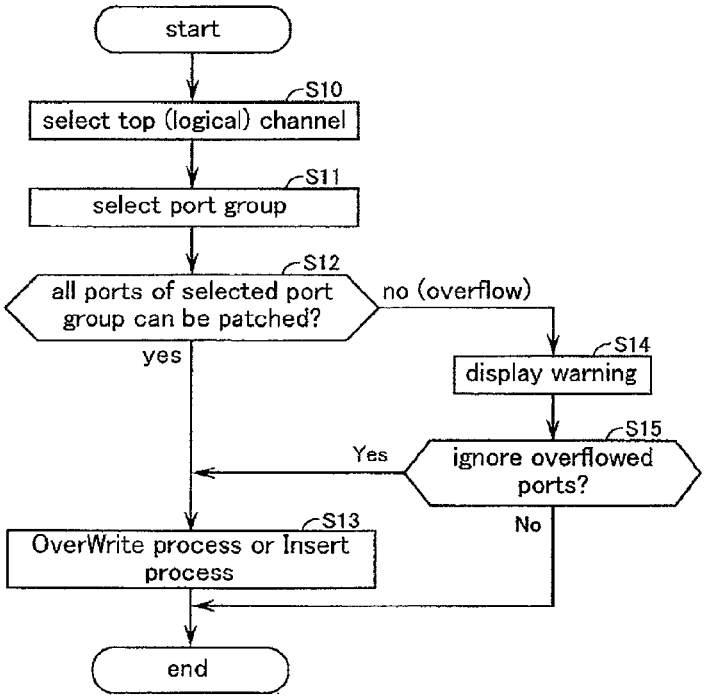
FIG. 9 is a flowchart of a patch process for patching a port group in the audio mixing system of the present invention.

FIG. 9 is a flowchart of a patch process for performing the above-described patching.

By a click on the patch button (Patch) 61*a* on the port group selection/patch screen 61, the patch process of FIG. 9 starts. In step S10, a logical channel selected in the selected channel field 61*b* is selected as the top channel. In step S11, a port group selected in the port group name field 61*d* is selected as a port group which will be collectively patched to the channels ranging from the top channel selected in step S10.

In step S12, port group information of the selected port group is read out to judge whether there are a large enough number of input channels to allow the patching of all the ports indicated by the information about the number of ports included in the port group information. In a case where it is judged that there are a large enough number of input channels to patch all the ports belonging to the selected port group, the process proceeds to step S13. In step S13, the above-described OverWrite process is performed in a case where the OverWrite button 61*f* has been clicked, whereas the Insert process is performed in a case where the Insert button 61*g* has been clicked.

In a case where it is judged in step S12 that there are not a large enough number of input channels to patch all the ports belonging to the port group to end up with overflow of the ports, the process branches to step S14 to display a warning about the overflow of the ports on the display portion 14, and then proceeds to step S15. In step S15, an inquiry made to the user about whether the overflowing ports can be ignored is displayed on the display portion 14. In a case where the user answers "yes", the process returns to step S13 to perform the above-described process. In a case where the user answers "no", the patch process terminates. After step S13, the patch process terminates.

Figure 10:
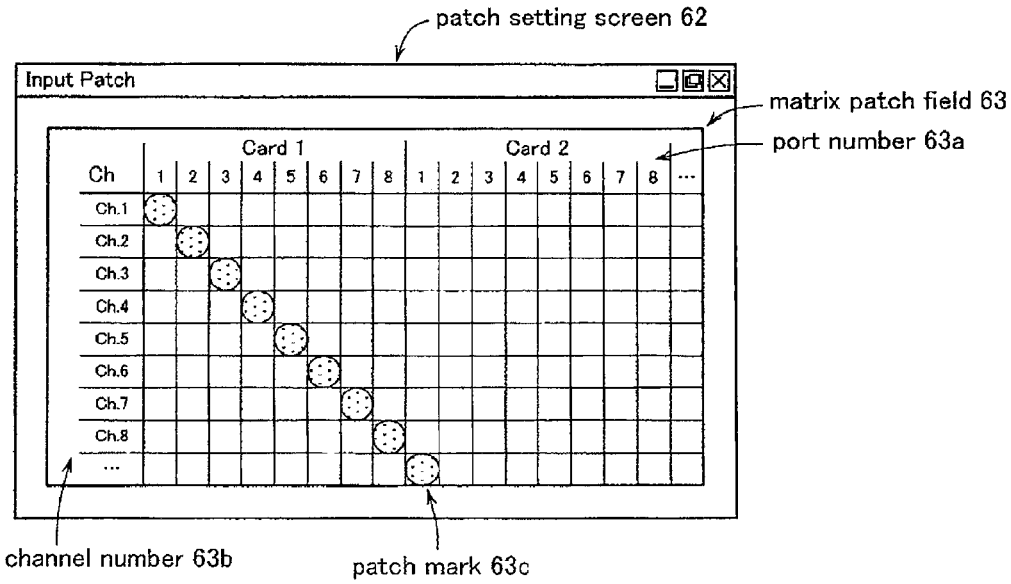
FIG. 10 is a patch setting screen for patching ports to channels in the audio mixing system of the present invention.

FIG. 10 indicates a patch setting screen 62 of "Input Patch" at which input ports are patched to input channels and which is displayed on the display portion 14 of the audio mixing system 1 of the present invention.

On the patch setting screen 62 shown in FIG. 10, a matrix patch field 63 for patching input ports to input channels is displayed. In the matrix patch field 63, port numbers 63*a* of input ports of Card 1, Card 2, etc. are displayed in a row as 1, 2, 3, . . . , 8, while channel numbers 63*b* of input channels are displayed in a column as "Channel 1", "Channel 2", "Channel 3", . . . . An input port patched to an input channel is indicated by a patch mark 63*c* displayed on a cell at which a corresponding row and a corresponding column intersect. The port numbers 63*a* such as 1, 2, 3, . . . , 8 correspond to Port 1, Port 2, Port 3, . . . , Port 8, respectively. In the shown example, the input port "Port 1" having the port number "1" of Card 1 is patched to the input channel "Channel 1". To the later input channels, furthermore, the input ports are patched in sequence as follows: The input port "Port 2" having the port number "2" of Card 1 is patched to the input channel "Channel 2", the input port "Port 3" having the port number "3" of Card 1 is patched to the input channel "Channel 3", and so on. To the input channel "Channel 9", the input port "Port 1" having the port number "1" of Card 2 is patched. To the later input channels "Channel 10" to "Channel 16", the input ports "Port 2" to "port 8" having the port numbers "2" to "8" of Card 2 are patched in sequence.

On this patch setting screen 62 as well, the user can edit the patching. In a case where the user desires to change the input patch, the user causes the patch setting screen 62 to display port numbers of input ports which are to be patched to input channels on the row indicative of the port number 63*a* and channel numbers of input channels to which the ports are to be patched on the column indicative of the channel numbers 63*b* in the matrix patch field 63. Then, the user clicks on a cell at which a user's desired input port and a user's desired input channel intersect. By the user's click, the user's desired input port is patched to the user's desired input channel, so that the patch mark 63*c* is displayed at the cell.

Figure 11:
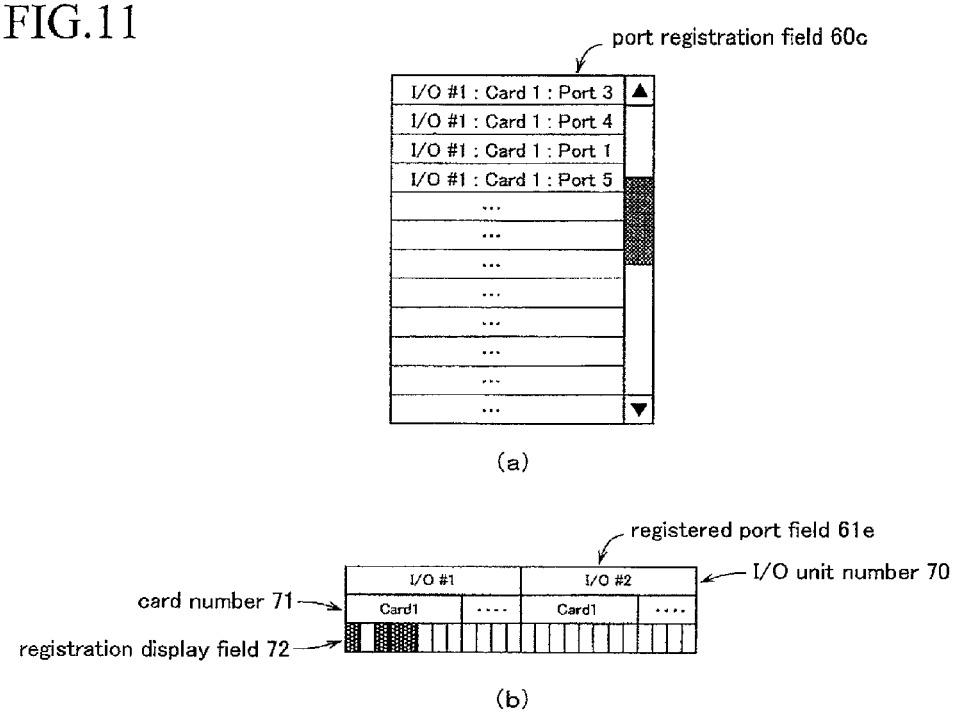
FIG. 11 is diagrams indicative of a configuration of a port group which is to be patched in the audio mixing system of the present invention.
Figure 12:
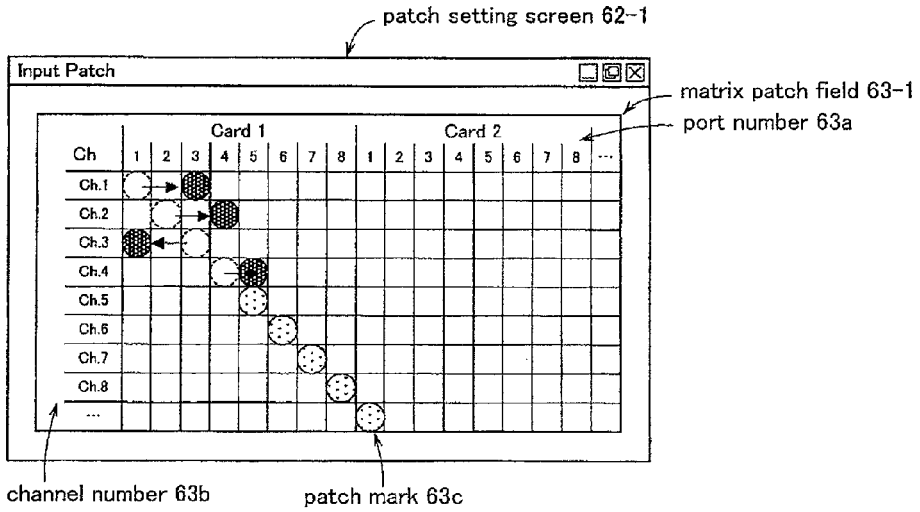
FIG. 12 is a patch setting screen of a state where an OverWrite process for patching a port group to channels has been performed in the audio mixing system of the present invention.

FIG. 12 indicates a patch setting screen 62-1 of a state where the above-described OverWrite process has been performed to collectively patch a port group to input channels. In the port group, in this case, input ports indicated in the port registration field 60*c* indicated in FIG. 11(*a*) are registered. To the port group, more specifically, ports "I/O #1: Card 1: Port 3", "I/O #1: Card 1: Port 4", "I/O #1: Card 1: Port 1", "I/O #1: Card 1: Port 5", . . . have been registered. This port group is indicated as shown in FIG. 11(*b*) in the registered port field 61*e* of the port group selection screen 61 of FIG. 8. More specifically, the color of positions corresponding to the ports "Port 1", "Port 3", "Port 4" and "Port 5" of Card 1 indicated in a card number 71 of I/O #1 indicated in an I/O unit number 70 of the registered port field 61*e* has been changed in a registration display field 72 to indicate that these ports have been registered.

FIG. 12 indicates the patch setting screen 62-1 of a state where the port group having four ports shown in FIG. 11(*a*) and FIG. 11(*b*) has been collectively patched to input channels by the OverWrite process.

As indicated in FIG. 12, on the patch setting screen 62-1 which indicates a patched state, because the port group has four ports, the execution of the OverWrite process causes changes in input ports patched to four input channels "Channel 1", "Channel 2", "Channel 3", and "Channel 4". More specifically, the port of port number "1" patched to the input channel "Channel 1" is replaced with Port 3 of port number "3" of Card 1 of I/O #1, so that Port 3 is patched to "Channel 1". The port patched to the second input channel "Channel 2" is replaced with Port 4 of port number "4" of Card 1 of I/O #1, so that Port 4 is patched to "Channel 2". The port patched to the third input channel "Channel 3" is replaced with Port 1 of port number "1" of Card 1 of I/O #1, so that Port 1 is patched to "Channel 3". The port patched to the fourth input channel "Channel 4" is replaced with Port 5 of port number "5" of Card 1 of I/O #1, so that "Port 5" is patched to "Channel 4". As for the above-described process, in a case where input channels to which ports will be patched exceed the last input channel, the patching to the last input channel is the last process, and any further process will not be performed. In order to indicate the changes in the patched ports, the color of the corresponding patch marks 63*c* is changed as indicated in the figure.

By the patching changes, the input port "Port 1" of port number "1" of Card 1 is patched to the input channel "Channel 3". The input port "Port 2" of port number "2" is not patched to any input channel. The input port "Port 3" of port number "3" is patched to the input channel "Channel 1". The input port "Port 4" of port number "4" is patched to the input channel "Channel 2". The input port "Port 5" of port number "5" is patched to the input channels "Channel 4" and "Channel 5". The patching of the later input ports has not been changed. More specifically, the input port "Port 6" of port number "6" is patched to the input channel "Channel 6". The input port "Port 7" of port number "7" is patched to the input channel "Channel 7". The later input ports are also patched similarly.

Although each input port can be patched to a plurality of input channels, each input channel can only be assigned one input port.

Figure 13:
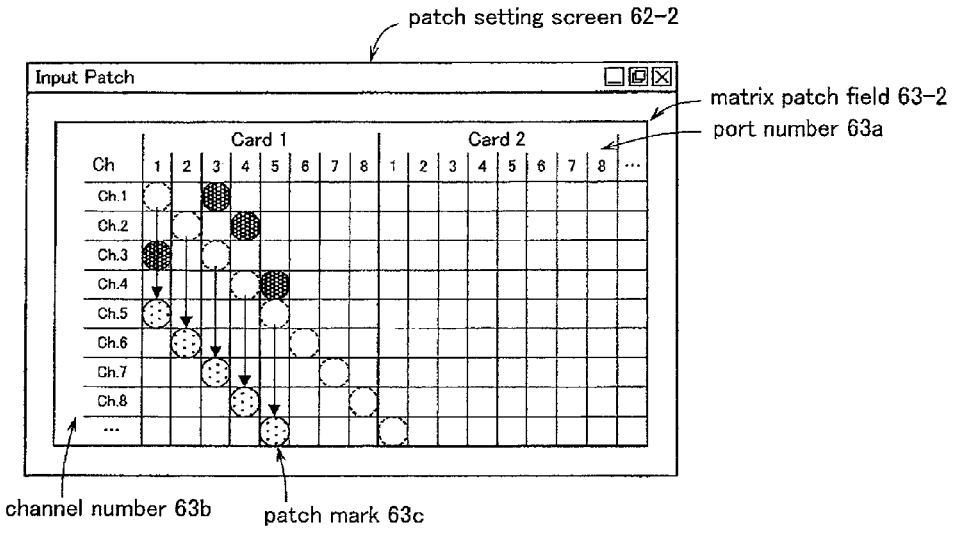
FIG. 13 is a patch setting screen of a state where an Insert process for patching a port group to channels has been performed in the audio mixing system of the present invention.

FIG. 13 indicates a patch setting screen 62-2 indicative of a state where the port group having four ports indicated in FIG. 11(*a*) and FIG. 11(*b*) has been collectively patched to input channels by the Insert process. As indicated in FIG. 13, on the patch setting screen 62-2 indicative of a patched state, because the port group has four ports, the execution of the Insert process causes the re-patching of input ports patched to all the input channels ranging from the top to later input channels to input channels whose respective channel numbers are greater by 4 than the originally patched input channels. Then, to the four vacant top and later input channels "Channel 1", "Channel 2", "Channel 3" and "Channel 4", the ports belonging to the port group having 4 ports are patched sequentially. To the top input channel "Channel 1", more specifically, Port 3 having the port number "3" of Card 1 of I/O #1 is patched. To the second input channel "Channel 2", Port 4 having the port number "4" of Card 1 of I/O #1 is patched. To the third input channel "Channel 3", Port 1 having the port number "1" of Card 1 of I/O #1 is patched. To the fourth input channel "Channel 4", Port 5 having the port number "5" of Card 1 of I/O #1 is patched. To the fifth input channel "Channel 5", Port 1 having the port number "1" of Card 1 of I/O #1 is patched. By the Insert process, as described above, the same number of input channels as the ports belonging to the port group are emptied, starting at the top channel, so that the ports of the port group can be inserted to be patched to the emptied input channels. As for the above-described process, in a case where input channels to which ports will be patched exceed the last input channel, the patching to the last input channel is the last process, and any further process will not be performed. In order to indicate the changes in the patched ports, the color of the corresponding patch marks 63*c* is changed as indicated in the figure. However, the color of the patch marks 63*c* of the channel "Channel 5" and the later channels to which the ports have been moved to be re-patched will not be changed.

By the patching changes, the input port "Port 1" of port number "1" of Card 1 is patched to the input channels "Channel 3" and "Channel 5". The input port "Port 2" of port number "2" is patched to the input channel "Channel 6". The input port "Port 3" of port number "3" is patched to the input channels "Channel 1" and "Channel 7". The input port "Port 4" of port number "4" is patched to the input channels "Channel 2" and "Channel 8". The input port "Port 5" of port number "5" is patched to the input channels "Channel 4" and "Channel 9". The later input ports are re-patched to the input channels whose respective channel numbers are greater by 4. More specifically, the input port "Port 6" of port number "6" is patched to the input channel "Channel 10". The input port "Port 7" of port number "7" is patched to the input channel "Channel 11". The later input ports are also patched similarly.

Although each input port can be patched to a plurality of input channels, each input channel can only be assigned one input port.

Figure 14:
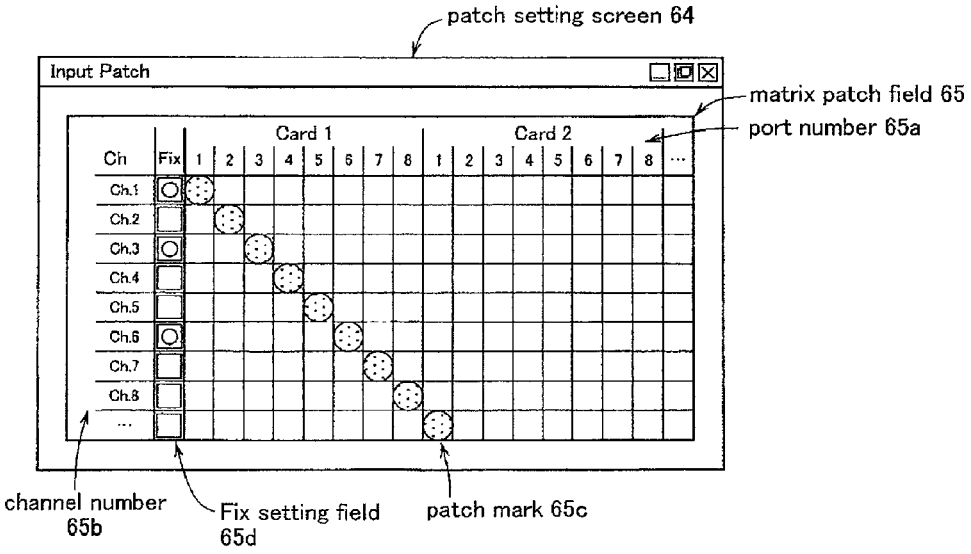
FIG. 14 is a patch setting screen for patching ports to channels each having a Fix flag in the audio mixing system of the present invention.

In some cases, there can be input/output ports which are desired to be fixed without changing patched input/output channels even at the collective patching of a port group to input/output channels. In order to realize the fixing, a Fix flag is provided for respective input/output channels so that flagged input/output channels will be fixed without changing their patching even at the time of the collective patching of port group to input/output channels. FIG. 14 indicates a patch setting screen 64 of "Input Patch" in which the input channels are provided with the Fix flag.

On the patch setting screen 64 shown in FIG. 14, a matrix patch field 65 for patching input ports to input channels is displayed. In the matrix patch field 65, port numbers 65*a* of input ports of Card 1, Card 2, etc. are displayed in a row as 1, 2, 3, . . . , 8, while channel numbers 65*b* of input channels are displayed in a column as "Channel 1", "Channel 2", "Channel 3", . . . . In a column, furthermore, a Fix setting field 65*d* for setting the Fix flag is provided for each input channel. For flagged input channels, "○" is indicated in the Fix setting field 65*d*. An input port patched to an input channel is indicated by a patch mark 65*c* displayed on a cell at which a corresponding row and a corresponding column intersect. The port numbers 65*a* such as 1, 2, 3, . . . , 8 correspond to Port 1, Port 2, Port 3, . . . , Port 8, respectively.

The Fix flag will be explained. In order to set the Fix flag for an input channel, a user clicks on the Fix setting field 65*d* corresponding to the input channel which is not flagged (that is, the Fix setting field without "○"). In order to cancel the Fix flag of a flagged input channel, a user clicks on the Fix setting field 65*d* corresponding to the input channel which has been flagged (that is, the Fix setting field with "○").

On the patch setting screen 64 of FIG. 14, the input channels "Channel 1", "Channel 3" and "Channel 6" are flagged. Even by the collective patching of a port group to input channels, therefore, the flagged input channels will be skipped to fix the patching of the flagged input channels, so that a port will be patched to an input channel of the next channel number.

Figure 15:
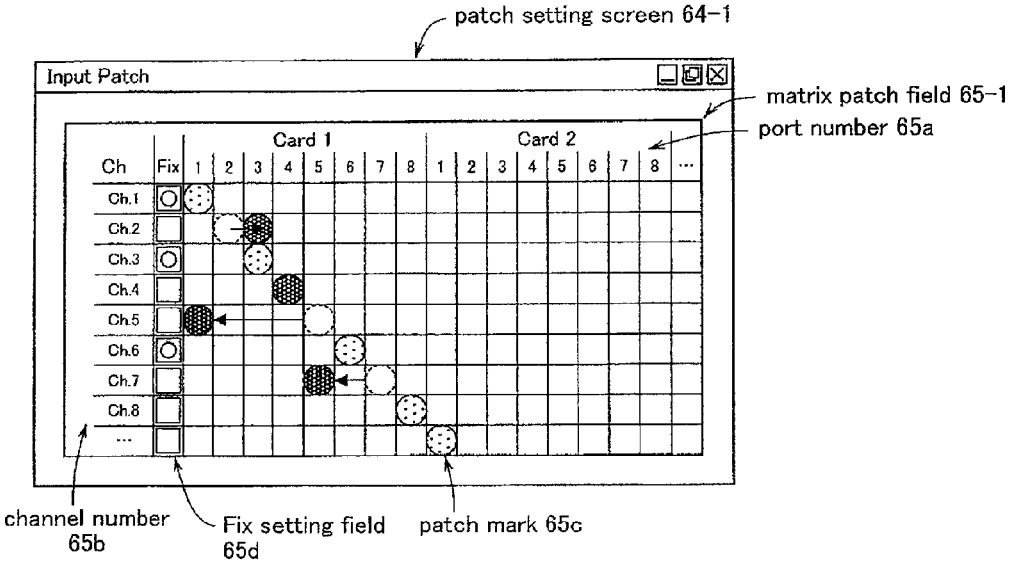
FIG. 15 is a patch setting screen of a state where the OverWrite process for patching a port group to channels having a Fix flag has been performed in the audio mixing system of the present invention.

FIG. 15 indicates a patch setting screen 64-1 of a state where the port group having four ports shown in FIG. 11(*a*) and FIG. 11(*b*) has been collectively patched to input channels by the OverWrite process on the patch setting screen 64.

As indicated in FIG. 15, on the patch setting screen 64-1 which indicates a patched state, because the port group has four ports, the execution of the OverWrite process causes changes in input ports patched to four input channels "Channel 1", "Channel 2", "Channel 3", and "Channel 4". Because of the Fix flag set on the input channels "Channel 1", "Channel 3" and "Channel 6", however, the input ports patched to these input channels are fixed. More specifically, the flagged input channel "Channel 1" is skipped, so that Port 3 of port number "3" of Card 1 of I/O #1 is to be patched to the next input channel "Channel 2" to replace the input port of port number "2" which has been patched to the input channel "Channel 2". Furthermore, the flagged next input channel "Channel 3" is also skipped, so that Port 4 of port number "4" of Card 1 of I/O #1 is to be patched to the next input channel "Channel 4" to replace the input port which has been patched to the input channel "Channel 4". In this case, however, the input port which is to be patched to the input channel "Channel 4" is the same input port as the port which has been patched to the input channel "Channel 4". Because the input channel "Channel 5" is not flagged, Port 1 of port number "1" of Card 1 of I/O #1 is to be patched to the input channel "Channel 5" to replace the input port which has been patched to the input channel "Channel 5". Furthermore, because the next input channel "Channel 6" is also flagged, the input channel "Channel 6" is also skipped, so that Port 5 of port number "5" of Card 1 of I/O #1 is to be patched to the next input channel "Channel 7" to replace the input port which has been patched to the input channel "Channel 7". As for the above-described process, in a case where input channels to which ports will be patched exceed the last input channel, the patching to the last input channel is the last process, and any further process will not be performed. In order to indicate the changes in the patched ports, the color of the corresponding patch marks 65*c* is changed as indicated in the figure.

By the patching changes, the input port "Port 1" of port number "1" of Card 1 is patched to the input channels "Channel 1" and "Channel 5". The input port "Port 2" of port number "2" is not patched to any input channel. The input port "Port 3" of port number "3" is patched to the input channels "Channel 2" and "Channel 3". The input port "Port 4" of port number "4" is patched to the input channel "Channel 4". The input port "Port 5" of port number "5" is patched to the input channel "Channel 7". The input port "Port 6" of port number "6" is patched to the input channel "Channel 6". The input port "Port 7" of port number "7" is not patched to any input channel. The patching of the later input ports has not been changed. More specifically, the input port "Port 8" of port number "8" is patched to the input channel "Channel 8", while the input port "Port 1" of port number "1" of Card 2 is patched to the input channel "Channel 9". The later input ports are also patched similarly.

Although each input port can be patched to a plurality of input channels, each input channel can only be assigned one input port.

Figure 16:
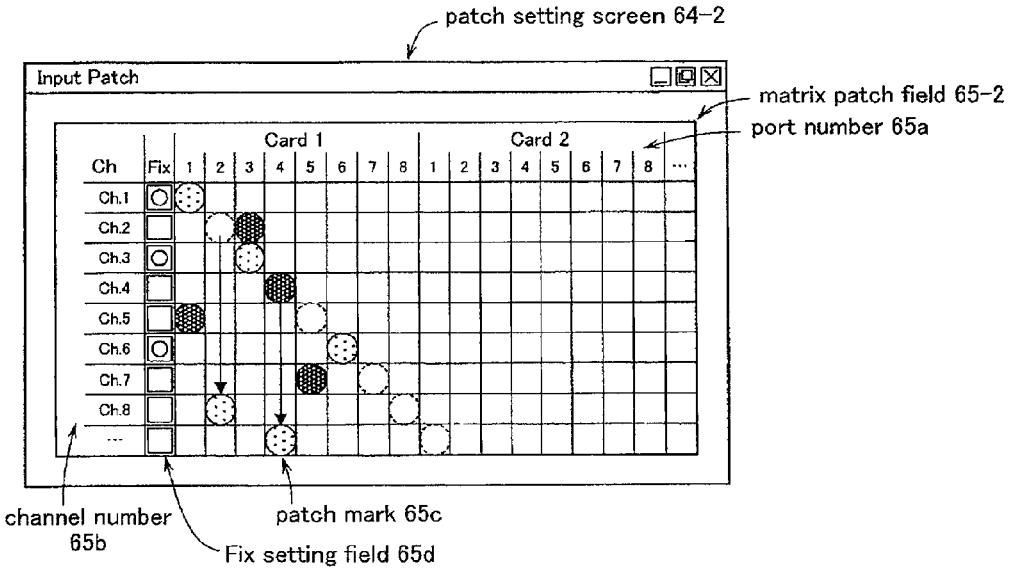
FIG. 16 is a patch setting screen of a state where the Insert process for patching a port group to channels having a Fix flag has been performed in the audio mixing system of the present invention.

FIG. 16 indicates a patch setting screen 64-2 indicative of a state where the port group having four ports indicated in FIG. 11(*a*) and FIG. 11(*b*) has been collectively patched to input channels on the patch setting screen 64 by the Insert process.

As indicated in FIG. 16, on the patch setting screen 64-2 indicative of a patched state, because the port group has four ports, the execution of the Insert process causes re-patching of input ports patched to all the input channels ranging from the top to later input channels to input channels whose respective channel numbers are greater by 4 than the originally patched channels. In this case, however, because the Fix flag is set for the input channels "Channel 1", "Channel 3" and "Channel 6", the input channels "Channel 1", "Channel 3" and "Channel 6" are fixed, so that the input ports will be re-patched without being patched to these flagged input channels. More specifically, the input ports will be moved by a certain number of channels obtained by taking the number of fixed input channels into account. Then, to the top and later vacant four input channels, the ports belonging to the port group having 4 ports are patched sequentially.

In this case, the top and later vacant four input channels are the input channels "Channel 2", "Channel 4", "Channel 5" and "Channel 7". For re-patching an input port, the input port will be re-patched to an input channel of a channel number obtained by adding 4 (i.e., four channels) to the number "k" of flagged input channels whose respective channel number are greater than the channel number of an originally patched input channel. Take the input port "Port 2" of the port number "2" as an example. Because the input channels "Channel 3" and "Channel 6" whose respective channel numbers are greater than the input channel "Channel 2" to which "Port 2" has been patched are flagged, the input port "Port 2" is re-patched to the input channel "Channel 8" which is greater by "4+2=6" than the patched input channel "Channel 2". Similarly, the input port "Port 4" of the port number "4" is re-patched to "Channel 9". The input port "Port 5" of the port number "5" is re-patched to "Channel 10". The input port "Port 7" of the port number "7" is re-patched to "Channel 11". The later input ports are to be re-patched to input channels whose respective channel numbers are greater by 4.

More specifically, "Channel 1" which is the top channel and for which the Fix flag is set will be skipped, while "Port 3" of the port number "3" of Card 1 of I/O #1 is patched to the first vacant input channel "Channel 2". The next flagged channel "Channel 3" will be also skipped, so that "Port 4" of the port number "4" of Card 1 of I/O #1 is patched to the next vacant channel "Channel 4". Because the next channel "Channel 5" is also vacant, Port 1 of the port number "1" of Card 1 of I/O #1 is patched to the input channel "Channel 5". Furthermore, because the next input channel "Channel 6" is also flagged, "Channel 6" will be skipped, so that "Port 5" of the port number "5" of Card 1 of I/O #1 is patched to the next vacant input channel "Channel 7". As for the above-described process, in a case where input channels to which ports will be patched exceed the last input channel, the patching to the last input channel is the last process, and any further process will not be performed. In order to indicate the changes in the patched ports, the color of the corresponding patch marks 65*c* is changed as indicated in the figure.

By the patching changes, the input port "Port 1" of port number "1" of Card 1 is patched to the input channels "Channel 1" and "Channel 5". The input port "Port 2" of port number "2" is patched to the input channel "Channel 8". The input port "Port 3" of port number "3" is patched to the input channels "Channel 2" and "Channel 3". The input port "Port 4" of port number "4" is patched to the input channels "Channel 4" and "Channel 9". The input port "Port 5" of port number "5" is patched to the input channels "Channel 7" and "Channel 10". The input port "Port 6" of port number "6" is patched to the input channel "Channel 6". The input port "Port 7" of port number "7" is patched to the input channel "Channel 11". The later input ports are re-patched to input channels whose respective channel numbers are greater by 4.

Although each input port can be patched to a plurality of input channels, each input channel can only be assigned one input port.

Figure 17:
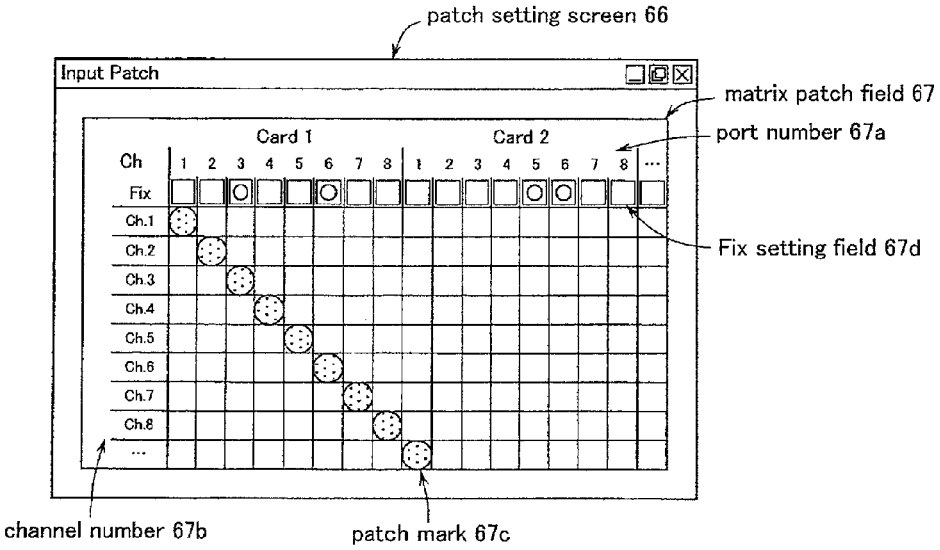
FIG. 17 is a patch setting screen for patching ports each having a Fix flag to channels in the audio mixing system of the present invention.

In some cases, there can be input/output ports which cannot be used due to different purposes or due to fault conditions even at the collective patching of a port group to input/output channels. In order to deal with such cases, a Fix flag is provided for each input/output port so that the patching will be modified such that flagged input/output ports will not be patched to any input/output channels even at the time of the collective patching of port group to input/output channels. FIG. 17 indicates a patch setting screen 66 of "Input Patch" in which each input port is provided with the Fix flag.

On the patch setting screen 66 shown in FIG. 17, a matrix patch field 67 for patching input ports to input channels is displayed. In the matrix patch field 67, port numbers 67*a* of input ports of Card 1, Card 2, etc. are displayed in a row as 1, 2, 3, . . . , 8, while a Fix setting field 67*d* for setting the Fix flag is provided for each input port. In a column, furthermore, channel numbers 67*b* of input channels are displayed as Channel 1, Channel 2, Channel 3, . . . . For flagged input ports, "○" is indicated in the Fix setting field 67*d*. An input port patched to an input channel is indicated by a patch mark 67*c* displayed on a cell at which a corresponding row and a corresponding column intersect. The port numbers 67*a* such as 1, 2, 3, . . . , 8 correspond to Port 1, Port 2, Port 3, . . . , Port 8, respectively.

The Fix flag will be explained. In order to set the Fix flag for an input port, a user clicks on the Fix setting field 67*d* corresponding to the input port which is not flagged (that is, the Fix setting field 67*d* without "○"). In order to cancel the Fix flag, the user clicks on the Fix setting field 67*d* corresponding to the input port which has been flagged (that is, the Fix setting field 67*d* with "○").

On the patch setting screen 66 of FIG. 17, the port numbers "3" and "6" of Card 1 and the port numbers "5" and "6" of Card 2 are flagged. Even by the collective patching of a port group to input channels, therefore, the patching will be modified such that the flagged input ports "Port 3" and "Port 6" of card 1 and the flagged input ports "Port 5" and "Port 6" of Card 2 will not be patched to any channels.

Figure 18:
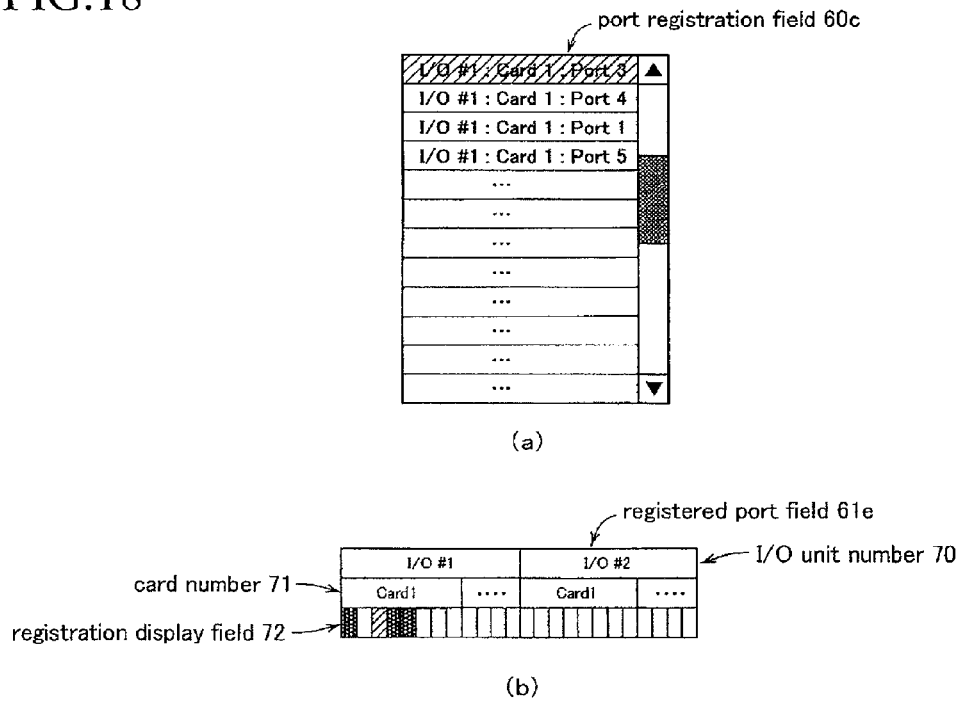
FIG. 18 is diagrams indicative of a configuration of a port group which is to be patched in the audio mixing system of the present invention.

For collective patching of a port group to input channels, input ports indicated in the port registration field 60*c* shown in FIG. 18(*a*) (see the port group UI screen 60 of FIG. 6) have been registered as the port group. As indicated in the figure, more specifically, the input ports "I/O #1: Card 1: Port 3", "I/O #1: Card 1: Port 4,", "I/O #1: Card 1: Port 1", "I/O #1: Card 1: Port 5", . . . have been registered as the port group. Furthermore, the input port "I/O #1: Card 1: Port 3" is indicated in gray in order to indicate that this input port cannot be used because the input port is reserved for a different purpose or because of a failure. In the registered port field 61*e* of the port group selection screen 61 of FIG. 8, this port group will be displayed as shown in FIG. 18(*b*). More specifically, in the registration display field 72, respective positions of the port numbers of "Port 1", "Port 4" and "Port 5" of Card 1 of the card number 71 of I/O #1 of the I/O unit number 70 of the registered port field 61*e* are indicated to show that these ports have been selected, while the position of the port number of "port 3" of Card 1 is displayed in gray to indicate that this port cannot be used.

Figure 19:
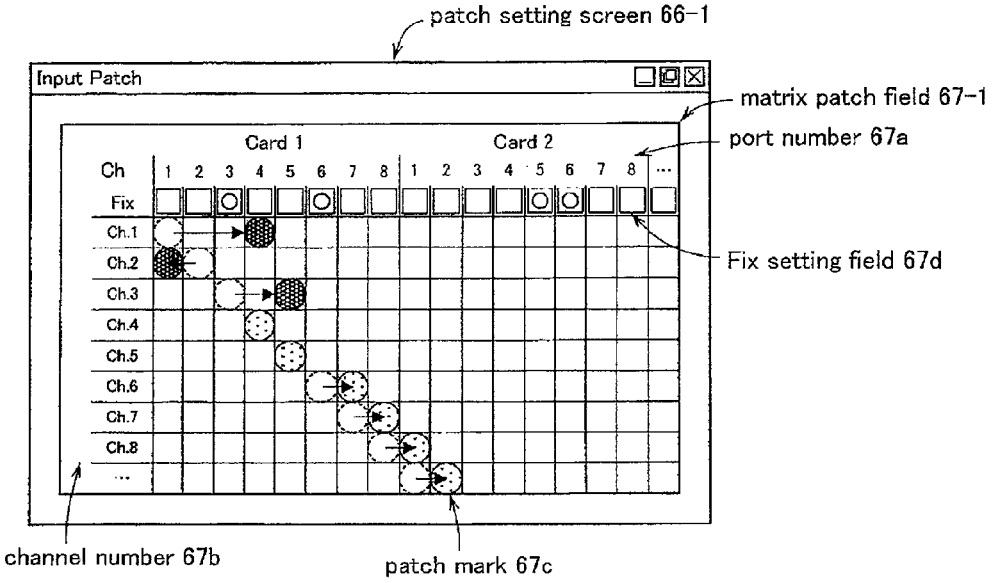
FIG. 19 is a patch setting screen of a state where the OverWrite process for patching a port group having ports for which the Fix flag is provided to channels has been performed in the audio mixing system of the present invention.

FIG. 19 indicates a patch setting screen 66-1 of a state where the port group having four ports shown in FIG. 18(*a*) and FIG. 18(*b*) has been collectively patched to input channels by the OverWrite process.

As indicated in FIG. 19, on the patch setting screen 66-1 which indicates a patched state, because the port group has four ports, the OverWrite process changes the patching such that the input ports of the port group will be patched to four input channels "Channel 1", "Channel 2", "Channel 3", and "Channel 4", respectively. Because of the Fix flag set on the input port of the port number "3" of Card 1 registered in the port group, however, the patching of this input port to the input channel is canceled. More specifically, because the Fix flag is set on the input port "Port 3" of the port number "3" of Card 1 of I/O #1 which is the first input port of the port group, the patch to the input channel "Channel 3" is canceled. Then, the next Port 4 of port number "4" of Card 1 of I/O #1 is patched to the input channel "Channel 1" to replace an input port which has been patched to the input channel "Channel 1". Furthermore, the next Port 1 of port number "1" of Card 1 of I/O #1 is patched to the input channel "Channel 2" to replace an input port which has been patched to the input channel "Channel 2". Then, the next Port 5 of port number "5" of Card 1 of I/O #1 is patched to the input channel "Channel 3" to replace an input port which has been patched to the input channel "Channel 3". In order to indicate the changes in the patched ports, the color of the corresponding patch marks 67*c* is changed as indicated in the figure.

Next, although the input port "Port 6" of port number "6" of Card 1 is not registered in the port group, the Fix flag is set on "Port 6". Therefore, the patching of "Port 6" to the input channel "Channel 6" is canceled, so that the input port "Port 7" of port number "7" of Card 1 is re-patched to "Channel 6". Because of this re-patching, the input port "Port 8" of port number "8" of Card 1 is re-patched to "Channel 7", while the input ports "Port 1" to "Port 4" of port numbers "1" to "4" of Card 2 are re-patched to the input channels "Channel 8" to "Channel 11", respectively. Furthermore, because the input ports "Port 5" and "Port 6" of port numbers "5" and "6" of Card 2 are flagged, the patching of these input ports to input channels are canceled. As for the above-described process, in a case where input channels to which ports will be patched exceed the last input channel, the patching to the last input channel is the last process, and any further process will not be performed.

By the patching changes, the input port "Port 1" of port number "1" of Card 1 is patched to the input channel "Channel 2". The input ports "Port 2" and "Port 3" of port numbers "2" and "3" are not patched to any input channels. The input port "Port 4" of port number "4" is patched to the input channels "Channel 1" and "Channel 4". The input port "Port 5" of port number "5" is patched to the input channels "Channel 3" and "Channel 5". The input port "Port 6" of port number "6" is not patched to any input channels. The input port "Port 7" of port number "7" is patched to the input channel "Channel 6". The input port "Port 8" of port number "8" is patched to the input channel "Channel 7". Furthermore, the input ports "Port 1" to "Port 4" of port numbers "1" to "4" of Card 2 are re-patched to channels "Channel 8" to "Channel 11", respectively.

Although each input port can be patched to a plurality of input channels, each input channel can only be assigned one input port.

Figure 20:
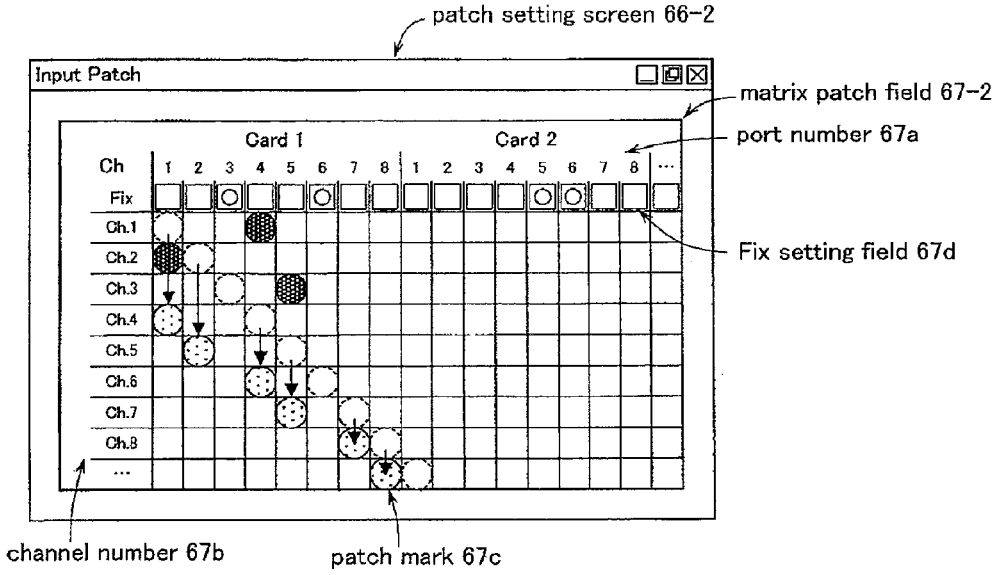
FIG. 20 is a patch setting screen of a state where the Insert process for patching a port group having ports for which the Fix flag is provided to channels has been performed in the audio mixing system of the present invention.
Figure 21:
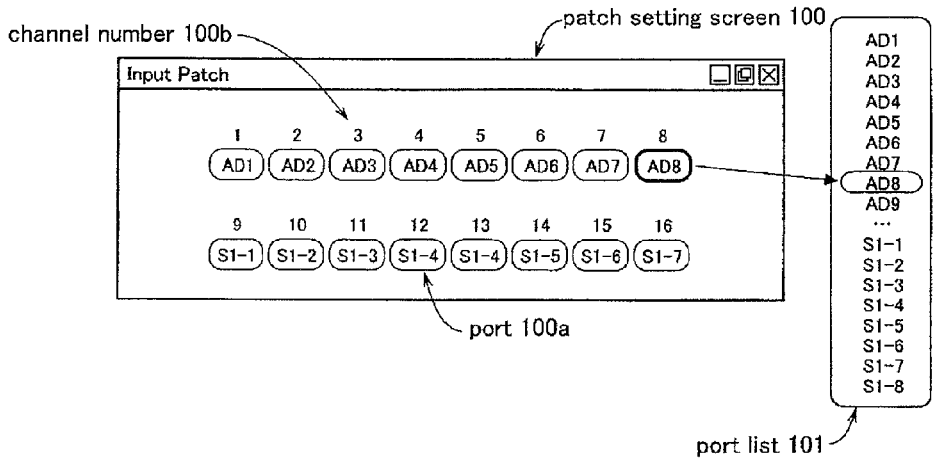
FIG. 21 is an example patch setting screen which is displayed on a conventional audio mixing system and at which ports are patched to channels.
Figure 22:
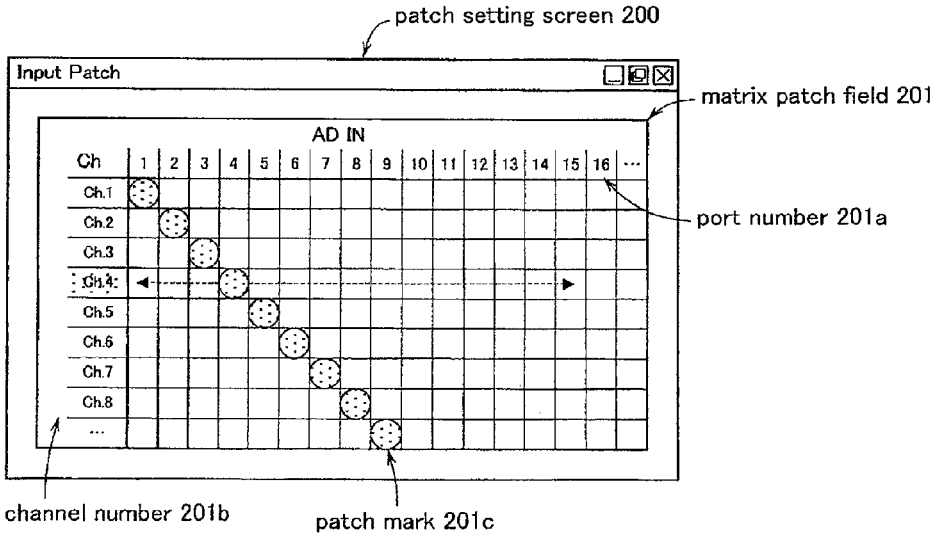
FIG. 22 is another example patch setting screen which is displayed on a conventional audio mixing system and at which ports are patched to channels.

FIG. 20 indicates a patch setting screen 66-2 indicative of a state where the port group having four ports indicated in FIG. 18(*a*) and FIG. 18(*b*) has been collectively patched to input channels on the patch setting screen 66 by the Insert process.

As indicated in FIG. 20, on the patch setting screen 66-2 indicative of a patched state, because the port group has four ports, the execution of the Insert process causes re-patching of input ports patched to all the input channels ranging from the top to later input channels to input channels whose respective channel numbers are greater by 4 than the originally patched channels. However, because the input port "Port 3" of port number "3" of Card 1 which is registered in the port group is flagged so that this port cannot be used, the input ports are re-patched to input channels whose respective channel numbers are greater by 3. In addition, because the input port of "Port 6" of port number "6" of Card 1 and the input ports "Port 5" and "Port 6" of port numbers "5" and "6" of Card 2 are also flagged, the patching is modified such that these ports will not be used. As a result, three input channels ranging from the first input channel are emptied. More specifically, the input port "Port 1" of port number "1" of Card 1 is re-patched from "Channel 1" to "Channel 4". The input port "Port 2" of port number "2" of Card 1 is re-patched from "Channel 2" to "Channel 5". The patch of the input channel to the input port "Port 3" of port number "3" of Card 1 is canceled. The input port "Port 4" of port number "4" of Card 1 is re-patched from "Channel 4" to "Channel 6". The input port "Port 5" of port number "5" of Card 1 is re-patched from "Channel 5" to "Channel 7". The patch of the input channel to the input port "Port 6" of port number "6" of Card 1 is canceled. The input port "Port 7" of port number "7" of Card 1 is re-patched from "Channel 7" to "Channel 8". The input port "Port 8" of port number "8" of Card 1 is re-patched from "Channel 8" to "Channel 9". As a result, the input channels "Channel 1" to "Channel 3" are emptied.

More specifically, because the Fix flag is set on the input port "Port 3" of the port number "3" of Card 1 of I/O #1 which is the first input port of the port group, the patch of the input port "Port 3" to the input channel "Channel 3" is canceled. Then, the next "Port 4" of port number "4" of Card 1 of I/O #1 is patched to the vacant top channel "Channel 1", while the next input port "port 1" of port number "1" of Card 1 of I/O #1 is patched to the next vacant input channel "Channel 2". Furthermore, the next "port 5" of port number "5" of card 1 of I/O #1 is patched to the next vacant input channel "Channel 3". As for the above-described process, in a case where input channels to which ports will be patched exceed the last input channel, the patching to the last input channel is the last process, and any further process will not be performed. In order to indicate the changes in the patched ports, the color of the corresponding patch marks 67*c* is changed as indicated in the figure.

By the patching changes, the input port "Port 1" of port number "1" of Card 1 is patched to the input channels "Channel 2" and "Channel 4". The input port "Port 2" of port number "2" of Card 1 is patched to the input channel "Channel 5". The input port "Port 3" of port number "3" is not patched to any input channels. The input port "Port 4" of port number "4" is patched to the input channels "Channel 1" and "Channel 6". The input port "Port 5" of port number "5" is patched to the input channels "Channel 3" and "Channel 7". The input port "Port 6" of port number "6" is not patched to any input channels. The input port "Port 7" of port number "7" is patched to the input channel "Channel 8". The input port "Port 8" of port number "8" is patched to the input channel "Channel 9". Furthermore, the input ports "Port 1" to "Port 4" of port numbers "1" to "4" of Card 2 are patched to input channels "Channel 10" to "Channel 13", respectively.

Although each input port can be patched to a plurality of input channels, each input channel can only be assigned one input port.

As for the above-described audio mixing system according to the embodiment of the present invention, the input patch has been explained concretely. As for the output patch as well, however, a port group formed of output ports can be similarly patched to output channels collectively.

In the audio mixing system of the present invention, furthermore, each physical port can be registered in a plurality of port groups. In a port group, furthermore, port numbers of ports registered in the port group may not be consecutive.

In the audio mixing system of the invention, furthermore, default port groups are defined. The port groups are provided, being organized by I/O unit and expansion card inserted into I/O unit.

What is claimed is:

1. An audio mixing system comprising:

a plurality of input ports adapted to receive input sound signals;

a plurality of output ports adapted to output sound signals;

a first processor and a digital signal processor adapted to perform digital signal processing of:

a plurality of input channels adapted to receive input sound signals from the plurality of input ports;

an input patch adapted for selectively patching the plurality of input ports to the plurality of input channels;

a mix bus adapted for mixing sound signals supplied from the plurality of input channels;

a plurality of output channels adapted for inputting sound signals mixed by the mix bus; and an output patch adapted for selectively patching the plurality of output ports to the plurality of output channels; and a display interface adapted to display:

registration of two or more input ports included in the plurality of input ports or two or more of output ports included in the plurality of output ports as a first plurality of patch ports;

registration of a first port group formed of the first plurality of patch ports;

registration of two or more input ports included in the plurality of input ports or two or more of output ports included in the plurality of output ports as a second plurality of patch ports;

registration of a second port group formed of the second plurality of patch ports;

editing of the first port group into an edited port group formed of an edited plurality of patch ports by displaying addition of an input port included in the plurality of input ports or an output port included in the plurality of output ports to the first plurality of patch ports to provide the edited plurality of patch ports or removal of a patch port from the first plurality of patch ports to provide the edited plurality of patch ports;

registration of the edited port group formed of the edited plurality of patch ports; and selection of one port group from among the registered edited port group and the registered second port group, wherein the first processor and the digital signal processor are adapted to perform:

collectively patching the plurality of patch ports belonging to the selected port group to two or more input channels included in the plurality of input channels or two or more output channels included in the plurality of output channels, respectively, by determining port-to-channel assignments of the plurality of patch ports to the two or more input or output channels, respectively, and connecting the plurality of patch ports to the two or more input or output channels, respectively.

2. The audio mixing system according to claim 1, wherein the display interface is adapted to display designation of a top channel of the plurality of channels to which the plurality of patch ports belonging to the selected port group are to be patched, and the first processor and the digital signal processor are adapted to perform sequentially patching the plurality of patch ports belonging to the selected port group to the two or more input channels included in the plurality of input channels or to the two or more output channels included in the plurality of output channels, starting at the designated top channel.

3. The audio mixing system according to claim 1, wherein the display interface is adapted to display designation of an input channel which is fixed without changing a state of patching of input port to the fixed input channel or designation of an output channel which is fixed without changing a state of patching of output port to the fixed output channel, and the designated input channel or the designated output channel is excluded from one or more target channels to which the plurality of patch ports belonging to the selected port group are to be patched.

4. The audio mixing system according to claim 2, wherein the first processor and the digital signal processor are adapted to perform re-patching, before said sequentially patching the plurality of patch ports belonging to the selected port group to the two or more input or output channels from the top channel, input ports or output ports which have been already patched to the top channel and later input or output channels to input channels or output channels displaced by as many channels as the patch ports belonging to the selected port group in a direction in which the patch ports belonging to the selected port group will be sequentially patched.

5. The audio mixing system according to claim 4, wherein the display interface is adapted to display designation of an input channel which is fixed without changing a state of patching of input port to the fixed input channel or designation of an output channel which is fixed without changing a state of patching of output port to the fixed output channel, and the designated input channel or the designated output channel is excluded from one or more target channels to which the plurality of patch ports belonging to the selected port group are to be patched, and is excluded from one or more target channels to which the input ports or the output ports are to be re-patched.

6. The audio mixing system according to claim 1, wherein the display interface is adapted to display designation of an input port which cannot be patched to any input channel or an output port which cannot be patched to any output channel, and the designated input port or the designated output port is excluded from one or more target ports which are to be patched to the plurality of input channels or the plurality of output channels.

7. The audio mixing system according to claim 6, wherein the first processor and the digital signal processor are adapted to perform canceling an already made patch of the designated input port or the designated output port to an input channel or an output channel.

8. A method applied to an audio mixing system having:

a plurality of input ports adapted to receive input sound signals;

a plurality of output ports adapted to output sound signals;

a first processor and a digital signal processor adapted to perform digital signal processing of:

a plurality of input channels adapted to receive input sound signals from the plurality of input ports;

a mix bus adapted for mixing sound signals supplied from the plurality of input channels; and a plurality of output channels adapted for inputting sound signals mixed by the mix bus, the method comprising the steps of:

selectively patching the plurality of input ports to the plurality of input channels;

selectively patching the plurality of output ports to the plurality of output channels;

registering two or more input ports included in the plurality of input ports or two or more output ports included in the plurality of output ports as a first plurality of patch ports;

registering a first port group formed of the first plurality of patch ports;

registering two or more input ports included in the plurality of input ports or two or more of output ports included in the plurality of output ports as a second plurality of patch ports;

registering a second port group formed of the second plurality of patch ports;

editing the first port group into an edited port group formed of an edited plurality of patch ports by adding an input port included in the plurality of input ports or an output port included in the plurality of output ports to the first plurality of patch ports to provide the edited plurality of patch ports or removing a patch port from the first plurality of patch ports to provide the edited plurality of patch ports;

registering the edited port group formed of the edited plurality of patch ports, selecting one port group from among the registered edited port group and the registered second port group; and collectively patching the plurality of patch ports belonging to the selected port group to two or more input channels included in the plurality of input channels or two or more output channels included in the plurality of output channels, respectively, by determining port-to-channel assignments of the plurality of patch ports to the two or more input or output channels, respectively, and connecting the plurality of patch ports to the two or more input or output channels, respectively.

9. A non-transitory storage medium storing a computer program that is to be executed by a computer to be applied to an audio mixing system having:

a plurality of input ports adapted to receive input sound signals;

a plurality of output ports adapted to output sound signals;

a first processor and a digital signal processor adapted to perform digital signal processing of:

a plurality of input channels adapted to receive input sound signals from the plurality of input ports;

a mix bus adapted for mixing sound signals supplied from the plurality of input channels; and a plurality of output channels adapted for inputting sound signals mixed by the mix bus, the computer program, when executed by the computer, causing the computer to perform a method comprising:

selectively patching the plurality of input ports to the plurality of input channels;

selectively patching the plurality of output ports to the plurality of output channels; and registering two or more input ports included in the plurality of input ports or two or more output ports included in the plurality of output ports as a first plurality of patch ports;

registering a first port group formed of the first plurality of patch ports;

registering two or more input ports included in the plurality of input ports or two or more of output ports included in the plurality of output ports as a second plurality of patch ports;

registering a second port group formed of the second plurality of patch ports;

editing the first port group into an edited port group formed of an edited plurality of patch ports by adding an input port included in the plurality of input ports or an output port included in the plurality of output ports to the first plurality of patch ports to provide the edited plurality of patch ports or removing a patch port from the first plurality of patch ports to provide the edited plurality of patch ports;

registering the edited port group formed of the edited plurality of patch ports;

selecting one port group from among the registered edited port group and the registered second port group; and collectively patching the plurality of patch ports belonging to the selected port group to two or more input channels included in the plurality of input channels or two or more output channels included in the plurality of output channels, respectively, by determining port-to-channel assignments of the plurality of patch ports to the two or more input or output channels, respectively, and connecting the plurality of patch ports to the two or more input or output channels, respectively.

* * * * *